US006192537B1

(12) United States Patent
Miki

(10) Patent No.: US 6,192,537 B1
(45) **Date of Patent: *Feb. 27, 2001**

(54) SEMI-FLUID BASED BODY SUPPORT SYSTEM

(76) Inventor: Sakae Miki, 5525-9 Ashikajima, Choshi, Chiba, 288-0005 (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/383,365

(22) Filed: Aug. 26, 1999

Related U.S. Application Data

(63) Continuation-in-part of application No. 09/143,278, filed on Aug. 28, 1998, now Pat. No. 6,016,581, which is a continuation-in-part of application No. 09/081,704, filed on May 19, 1998, now abandoned, which is a continuation-in-part of application No. 08/896,300, filed on Jun. 27, 1997, now abandoned.

(51) Int. Cl.[7] ..... A61G 7/057
(52) U.S. Cl. ..... 5/689; 5/702; 5/912
(58) Field of Search ..... 5/619, 615, 698, 5/697, 702, 714, 715, 655.4, 657, 911, 912, 933, 689

(56) References Cited

U.S. PATENT DOCUMENTS

| | | |
|---|---|---|
| 3,840,920 | 10/1974 | Voelker . |
| 4,114,214 | 9/1978 | VonHeck . |
| 4,483,029 | 11/1984 | Paul . |
| 4,599,755 | 7/1986 | Tominaga . |
| 4,637,083 | 1/1987 | Goodwin . |
| 4,686,723 | 8/1987 | Smith . |
| 4,768,250 | 9/1988 | Kato . |
| 4,794,659 | 1/1989 | Kurita et al. . |
| 4,835,802 | 6/1989 | Purcy et al. . |
| 4,914,760 | 4/1990 | Hargest et al. . |
| 4,942,635 | 7/1990 | Hargest et al. . |

(List continued on next page.)

FOREIGN PATENT DOCUMENTS

| | | |
|---|---|---|
| 3716263 | 11/1988 | (DE) . |
| 0051550 | 5/1982 | (EP) . |

OTHER PUBLICATIONS

International search report to PCT/JP 99/05898, mailed on Mar. 1, 2000 for "Semi–Fluid Based Body Support System" Miki, Sakae.

*Primary Examiner*—Michael F. Trettel

(57) ABSTRACT

A semi-fluid based body support system using a mass of granular material to support a user has reversible transferring means and fluidizing means to locally control the granular material. The reversible transferring means and fluidizing means are independently controlled at plural locations along a system longitudinal dimension so that each region of the user body may be independently accommodated. The reversible transferring means is used to achieve fitness for natural posture by controlling a distribution of the accumulative height of granular material, and transfers the granular material between a transverse middle portion and transverse side portions of the system reversibly. The fluidizing means is used to achieve reduced partial oppression by controlling a local fluidity of the granular material. In a preferred embodiment, rotary blade devices, placed at spaced locations along the system longitudinal dimension, implement the fluidizing and transferring means by switching between operational modes. The rotary blade devices each include a shaft with blades that is rotatable reversibly. A shaft axis of rotation is oriented at an angle in the approximate range of 60° to 120° relative to a system longitudinal axis. The blades extend over a zone on the shaft, wherein: the length of the zone is larger than 25% of a system transverse dimension; and the zone is located within a complementary half of the system transverse dimension. Blades located within the same zone have the same screw direction. Blades located within mutually opposite transverse halves of the system have opposite screw directions.

32 Claims, 25 Drawing Sheets

U.S. PATENT DOCUMENTS

| | | | |
|---|---|---|---|
| 4,951,335 | 8/1990 | Eady . | |
| 4,967,431 | 11/1990 | Hargest et al. . | |
| 5,008,965 | 4/1991 | Vrzalik . | |
| 5,168,591 | 12/1992 | Hakumium et al. . | |
| 5,388,291 | 2/1995 | Roux . | |
| 5,408,711 | 4/1995 | McClelland . | |
| 5,539,943 | 7/1996 | Romano . | |
| 5,590,430 | 1/1997 | Sereboff . | |
| 5,781,943 | 7/1998 | Moenning et al. . | |
| 6,016,581 * | 1/2000 | Miki | 5/689 |

* cited by examiner

SEMI-FLUID BASED BODY SUPPORT SYSTEM

CROSS-REFERENCE TO RELATED APPLICATIONS

This application is a Continuation-in-Part application of U.S. patent application Ser. No. 09/143,278, entitled "Semi-Fluid Mattress", filed Aug. 28, 1998, now U.S. Pat. No. 6,016,581, which is a Continuation-in-Part Application of U.S. patent application Ser. No. 09/081,704, entitled "Semi Fluid Home Mattress", filed May 19, 1998, now abandoned, which is a Continuation-in-Part Application of U.S. patent application Ser. No. 08/896,300, entitled "Semi Fluid Home Mattress", filed Jun. 27, 1997 now abandoned. The disclosures of the above-referenced patent applications are incorporated herein by reference in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention in general relates to a bed system. More particularly, this invention relates to a user support system for a bed, such as a mattress, which uses fluidizable granular material to support the user thereon.

The quality of sleep is generally influenced by the features of the mattress. The characteristics of a mattress affect the health of the user during the course of long time intervals. Important characteristics of the mattress can be considered to include reduced partial oppression, fitness for natural posture, stability in holding the user and potential for good ventilation.

In ordinary homes, water mattresses, air mattresses and gel mattresses are widely known as mattresses having a soft feel. Although these mattresses are simple in structure and are moderate in price, they have some problems which need to be overcome. These problems include several of:

(a) partial oppression caused by the tension of a sealed container holding the fluid;
(b) deterioration of supported posture, caused by a difference in weight (or specific gravity) of regions of the body;
(c) low stability in holding the body, resulting from high fluidity of the fluid;
(d) lack of ventilation, due to the use of the sealed container; and
(e) thermal disharmony caused by a large thermal capacity of a mass of water.

In the medical fields, fluidized beds are used for supporting the patient with little partial oppression. There are some problems associated with using fluidized beds in the home, including several of:

(a) extra weight relating to buoyancy of the fluidized granular material;
(b) extra energy consumed for thermal conditioning of the pressurized air;
(c) deterioration of supported posture, caused by a difference in weight (or specific gravity) of regions of the body; and
(d) unstable controllability in fluidizing the granular material, relating to the aerodynamics.

With respect to fluidized beds, the Goodwin patent (U.S. Pat. No. 4,637,083) discloses a fluidized patient support apparatus, the Eady patent (U.S. Pat. No. 4,951,335) discloses a mattress assembly, the Smith patent (U.S. Pat. No. 4,686,723) discloses a semi-fluidized bed, the Kato patent (U.S. Pat. No. 4,768,250) discloses a fluidized bead bed, the Romano patent (U.S. Pat. No. 5,539,943) discloses an apparatus and method for percussion of fluidized support surface and the Voelker patent (U.S. Pat. No. 3,840,920) discloses an adjustable mattress for pregnant mothers.

BRIEF SUMMARY OF THE INVENTION

It is an object of the present invention to provide a semi-fluid based body support system having reduced partial oppression, fitness for natural posture, stability in holding the user, potential for good ventilation and moderate (or relative) balance.

It is another object of the present invention to provide a semi-fluid based body support system including relatively simple machinery which is suitable for the fine and firm control of the granular material and is also suitable for a home bed with a shallow and wide structure.

It is another object of the present invention to provide a semi-fluid based body support system having reduced weight.

The semi-fluid based body support system of this invention is suitable for a mattress and a bed. The semi-fluid based body support system is applicable to mattresses and beds in the medical fields where it is required to support a patient in reduced partial oppression. The patient or nurse can adjust this semi-fluid based body support system to fit the natural posture of the patient attained during sleep. This semi-fluid based body support system does not need the flow of pressurized air, so it is relatively easy to keep a bed warm. Furthermore, the mechanism of this semi-fluid based body support system can be embodied in a shallow and wide structure which is often used in a home bed. Therefore, this semi-fluid based body support system is especially suitable for a home mattress and a home bed in everyday life. Since this semi-fluid based body support system solves, to some extent, a conflict between reduced partial oppression and fitness for natural posture, this system has the potential of improving the quality of sleep in the home mattress and the home bed.

The semi-fluid based body support system of this invention is also suitable for production using automatic machine tools because the main machinery of this system can be embodied by repetitions of relatively simple apparatus, such as a rotary blade device.

The semi-fluid based body support system of this invention also gives a benefit of motive power to sleep because it can really apply powerful machinery to a mattress and a bed.

Other features and advantages of this invention will be apparent from the detailed description of the invention, and from the claims.

DETAILED DESCRIPTION OF THE INVENTION

Figure 1:
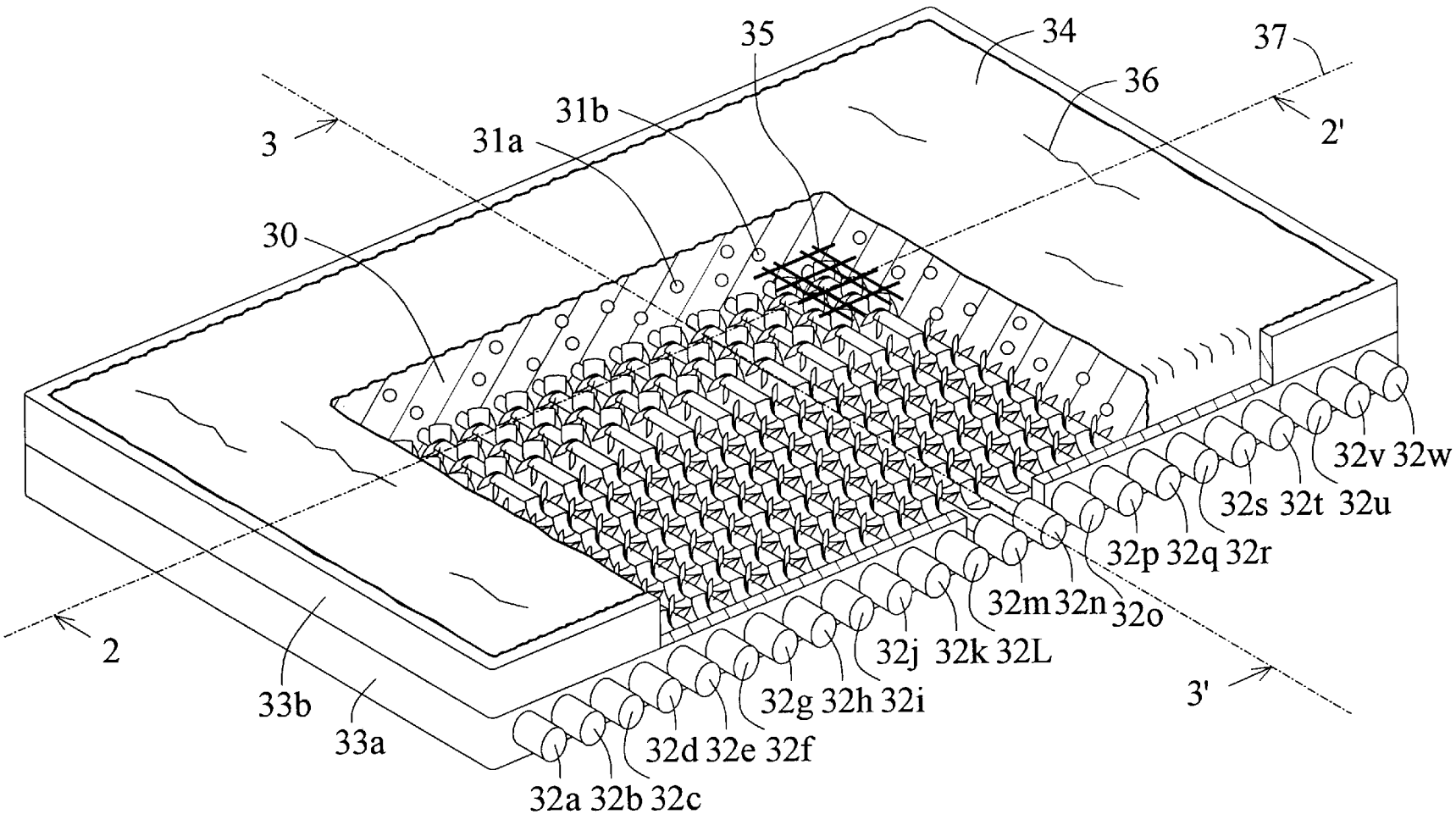
FIG. 1 is a partial cutaway perspective view of a preferred embodiment of a semi-fluid based body support system of the present invention, illustrating internal granular material and rotary blade devices.
Figure 2:
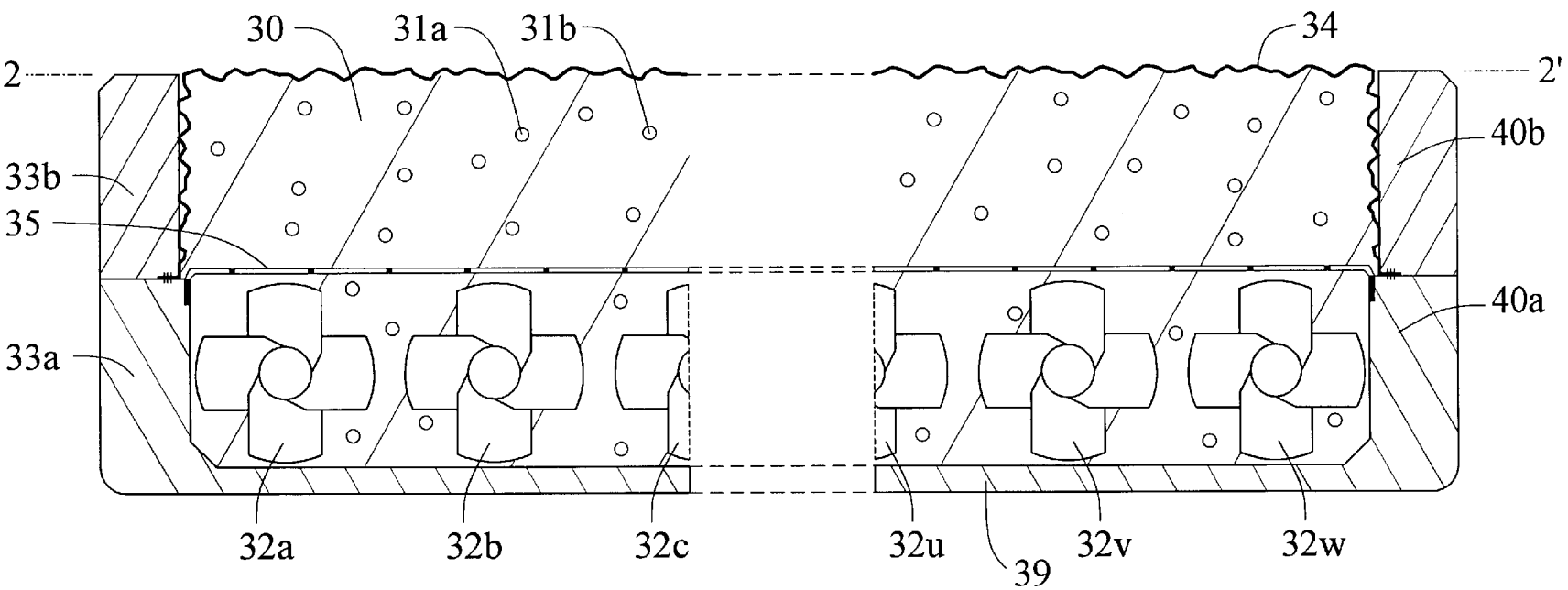
FIG. 2 is a partial vertical sectional view taken on line 2–2' of FIG. 1.
Figure 3:
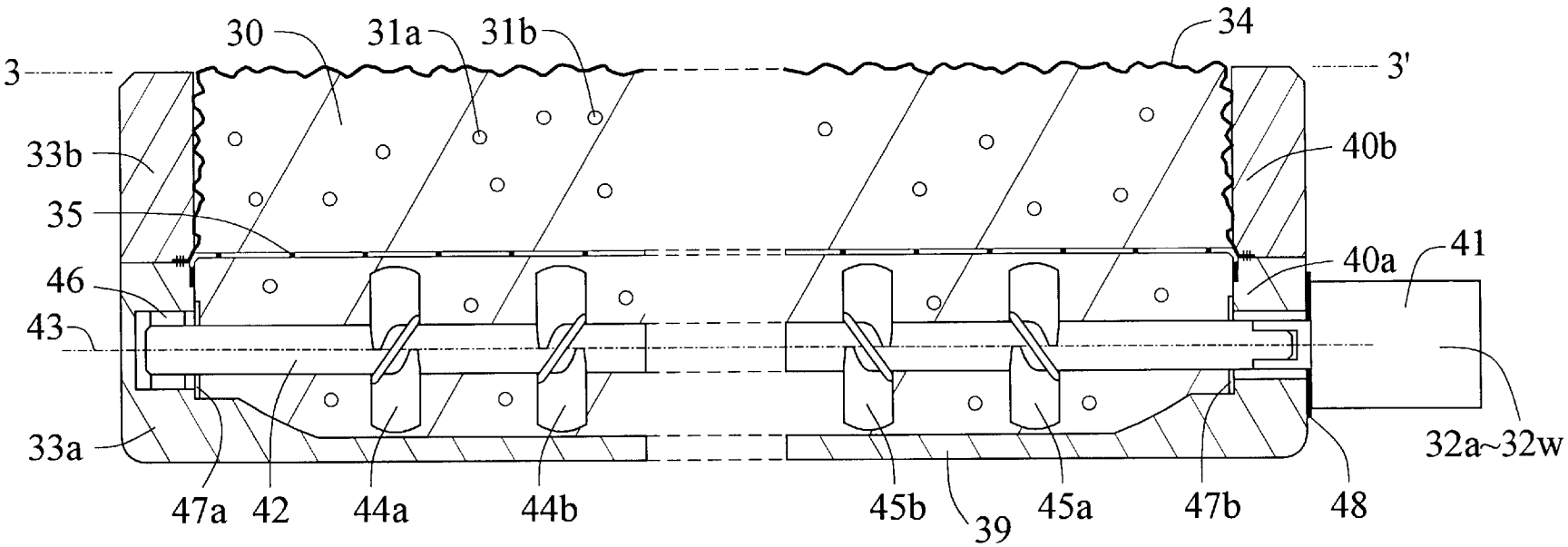
FIG. 3 is a partial vertical sectional view taken on line 3–3' of FIGS. 1, 12 and 16.
Figure 4:
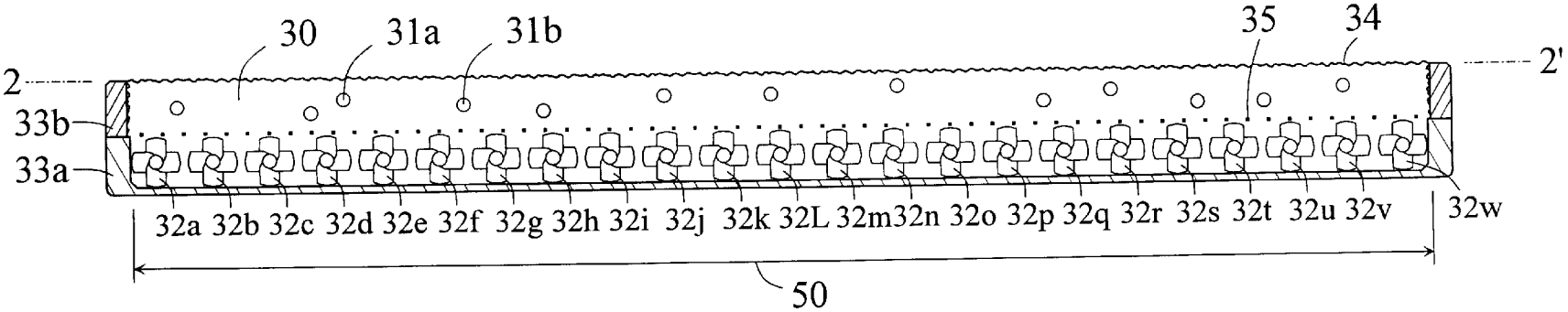
FIG. 4 is a schematic vertical sectional view taken on line 2–2' of FIG. 1.

FIGS. 1 through 11 illustrate the first preferred embodiment of a semi-fluid based body support system of this invention. The semi-fluid based body support system of this embodiment comprises a frame 33*a*–33*b* having a floor 39 and a wall 40*a*–40*b*, a mass of granular material 30 held (or disposed) in the frame 33*a*–33*b*, means for fluidizing the granular material 31*a*–31*b* and means for transferring the granular material 31*a*–31*b*, as illustrated in FIGS. 1, 2 and 3. The user is supported on the granular material 31*a*–31*b* through an air permeable sheet 34 which is connected to the wall 40*a*–40*b* of the frame 33*a*–33*b*.

The frame 33*a*–33*b* is composed of a base frame 33*a* and a cushion frame 33*b*. The base frame 33*a* holds the machinery and fixes the hem of the air permeable sheet 34. The machinery is mainly composed of rotary blade devices 32*a*–32*w*, which are discussed below, and related components. The machinery drives the granular material 31*a*–31*b* finely and firmly to assist the user in obtaining an appropriate support condition in each region of his body. A safety net member 35 is placed over the machinery to protect the user from the machinery. A safety net member 35 is supported by the base frame 33*a*. The cushion frame 33*b* surrounds the air permeable sheet 34 and provides a soft feel for the user. The term "floor of the frame" as used herein is intended to represent a member (or portion) of the frame 33*a*–33*b*, which substantially forms a floor surface at a base portion of the frame 33*a*–33*b*. The term "wall of the frame" as used herein is intended to represent a member (or portion) of the frame 33*a*–33*b*, which substantially forms a wall surface at a side portion of the frame 33*a*–33*b*.

The granular material 31*a*–31*b*, such as solid grains, beads, or the like, operates in a stationary state, in a grainy state and in a fluent state. The term "semi-fluid" as used herein is an alias of the granular material 31*a*–31*b* based on its function.

By nature, the semi-fluid based body support system of this embodiment has the potential for good ventilation passing through the granular material and has stability in holding the user due to low fluidity of the granular material in its stationary state.

In order to obtain both reduced partial oppression and fitness for natural posture, the semi-fluid based body support system of this embodiment comprises:

(1) means for fluidizing the granular material 31*a*–31*b*, wherein the fluidizing means independently controls the fluidizing of the granular material 31*a*–31*b* at more than one place along a longitudinal dimension 50 of the frame 33*a*–33*b*; and (2) means for transferring the granular material 31*a*–31*b* between a transverse middle portion 54 and transverse side portions 55*a* and 55*b* of the frame 33*a*–33*b*, wherein: a transfer direction of the transferring means is reversible; and the transferring means independently controls the transferring of the granular material 31*a*–31*b* at more than one location along a longitudinal dimension 50 of the frame 33*a*–33*b*.

The fluidizing means is used to reduce the partial oppression by locally fluidizing the granular material 31*a*–31*b* in the places corresponding to each region 51 of the user's body. Also, the transferring means is used to fit this semi-fluid based body support system to the natural posture of the user by adjusting an accumulative height 53 of the granular material 31*a*–31*b* in the locations corresponding to each region 51 of a body. The above places and locations can overlap with each other.

The transferring means functions as means for adjusting an accumulative height 53 of the granular material 31*a*–31*b* in the transverse middle portion 54 of the frame 33*a*–33*b*. Thus, in other words, the above-mentioned adjusting means independently controls the adjustment of the accumulative height 53 of the granular material 31*a*–31*b* at more than one location along the longitudinal dimension 50 of the frame 33*a*–33*b*.

The term "partial oppression" as used herein is intended to represent the concentration of pressure in a narrow area on the surface of the body in supporting a user's weight, generally depending on the shape of the support surface of this semi-fluid based body support system. The term "reduced partial oppression" as used herein is intended to represent relatively reduced partial oppression in a general sense. The term "fitness for natural posture" as used herein is intended to represent the ability to fit this semi-fluid based body support system adaptively to a medically natural posture (or attitude) attained during sleep or to a posture desired by the user. As for a pressure distribution on the surface of the body, the reduction of the partial oppression corresponds to an equalization of the pressure in a local area, and fitness for the natural posture corresponds to a redistribution of the pressure in a global area.

The fluidizing means and the transferring means can be realized under two kinds of apparatus. However, in this embodiment, to simplify the structure of the machinery, these means are realized under one kind of apparatus which is applicable to both means by changing its operational mode. This apparatus is a rotary blade device as called herein. In other words, the fluidizing means and the transferring means jointly comprise the rotary blade device.

Plural rotary blade devices 32*a*–32*w* are supported by the frame 33*a*–33*b* as illustrated in FIGS. 1, 2 and 3. The rotary blade devices 32*a*–32*w* are located along the longitudinal dimension 50 of the frame 33*a*–33*b*, and preferably should be installed near the bottom of the frame 33*a*–33*b* in an array. Preferably, each of the rotary blade devices 32*a*–32*w* should be independently controlled so that each region of the user's body may be independently cared for.

Each of the rotary blade devices 32*a*–32*w* includes:

(a) a shaft member 42 rotatable on an axis of rotation 43 being oriented at an angle in the approximate range of 60° to 120°, preferably from 80° to 100° and desirably 90°, relative to a longitudinal axis 37 of the frame 33*a*–33*b*, wherein the shaft member is rotatable reversibly; and (b) a blade member 60*a* connected to the shaft member 42.

The term "shaft member" as used herein is intended to represent a member which translates rotatory power to the blade member 60*a* and has a simple or complex rod-like or pipe-like structure usually called a shaft. The term "blade member" as used herein is intended to represent a member which drives the granular material 31*a*–31*b* by rotating on the axis of rotation 43 and has a simple or complex plate-like or blade-like structure usually called a blade, vane or fin.

The rotary blade devices 32*a*–32*w* can include a sole blade (i.e. single blade) and/or a continuous blade, such as the blade member 60*a*. The blade member 60*a* can be directly connected to the shaft member 42, but also can be substantially connected to the shaft member 42 through a coupling, such as a clutch. Usually, the blade members are located at spaced locations on the shaft member 42. The rotary blade devices 32*a*–32*w* also can include an impeller member 44*g* composed of the blade members 60*a*–60*d*. The term "impeller member" as used herein is intended to represent a member which has an impeller-like or runner-like structure made by plural blade members 60*a*–60*d* and is usually called an impeller, screw, fan or propeller.

Each of the rotary blade devices 32*a*–32*w* includes left-handed impeller members 44*a*–44*g* and right-handed impeller members 45*a*–45*g* as illustrated in FIGS. 3, 5, 6 and 7. Each of the left-handed impeller members 44*a*–44*g* is composed of the blade members 60*a*–60*d* having a left-handed screw direction, and each of the right-handed impeller members 45*a*–45*g* is composed of the blade members 61*a*–61*d* having a right-handed screw direction.

Figure 5:
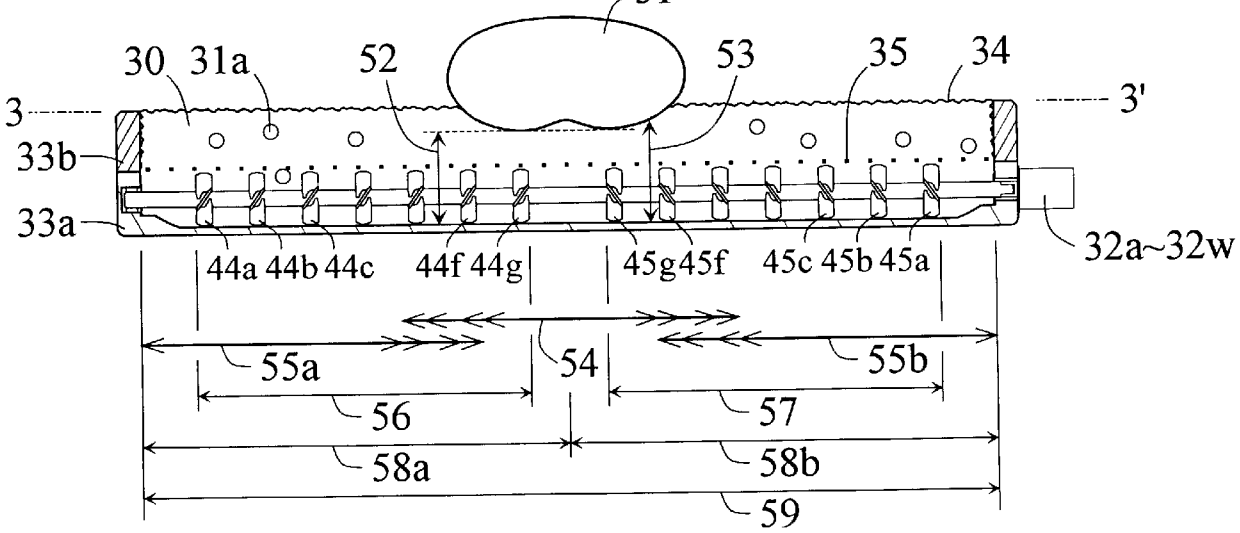
FIG. 5 is a schematic vertical sectional view taken on line 3–3' of FIGS. 1, 12 and 16, illustrating a condition of supporting the user.
Figure 6:
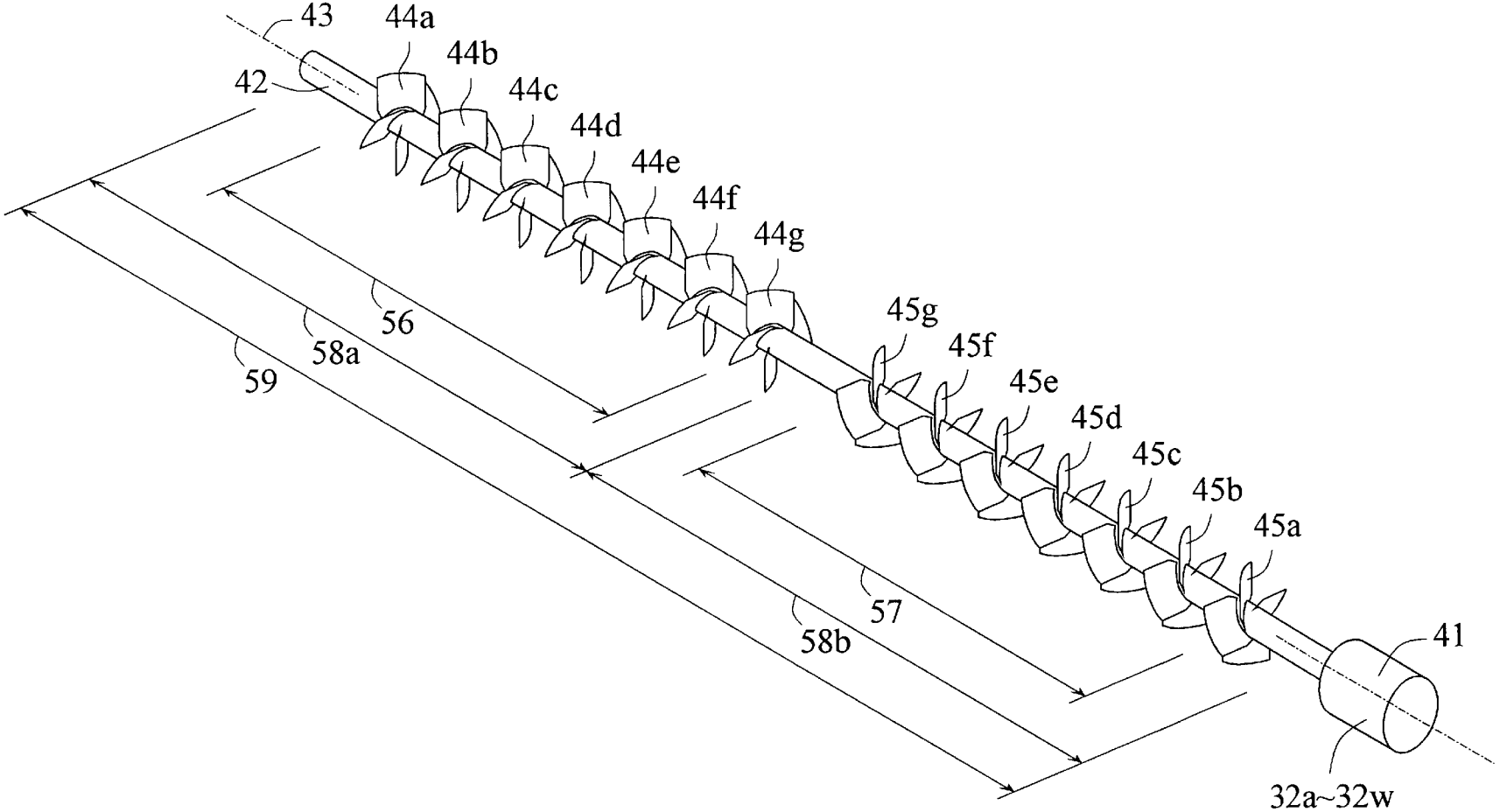
FIG. 6 is a perspective view of the rotary blade device.

At this point, as illustrated in FIGS. 5 and 6, the frame 33*a*–33*b* defines a left zone 56 and a right zone 57 on the shaft member 42, wherein: the length of each of the left zone 56 and the right zone 57 is larger than 25% of a transverse dimension 59 of the frame 33*a*–33*b*; and the left zone 56 and the right zone 57 are located within complementary halves 58*a* and 58*b* of the transverse dimension 59 of the frame 33*a*–33*b*, respectively.

Each complementary half of the transverse dimension 59 of the frame 33*a*–33*b* corresponds to a space (or an extent) between a central longitudinal axis of the frame 33*a*–33*b* and a transverse side of the frame 33*a*–33*b*. Thus, for example, the left zone 56 is disposed between a central longitudinal axis of the frame 33*a*–33*b* and a transverse side of the frame 33*a*–33*b*, and length of the left zone 56 is larger than 25% of a transverse dimension of the frame 33*a*–33*b*.

Preferably, placement of the blade members of the left-handed impeller members 44*a*–44*g* should extend over the left zone 56, while placement of the blade members of the right-handed impeller members 45*a*–45*g* should extend over the right zone 57.

Preferably, the blade members of the left-handed impeller members 44*a*–44*g* located within the same zone 56 should have a uniform 63*a* (i.e. the same) screw direction 62*a*, and also the blade members of right-handed impeller members 45*a*–45*g* located within the same zone 57 should have a uniform 63*b* (i.e. the same) screw direction 62*b*. The directions 63*a* and 63*b* indicate screw directions 62*a* and 62*b* along the axis of rotation 43, respectively.

Preferably, the blade members of the left-handed impeller members 44*a*–44*g* located within the left zone 56 and the blade members of the right-handed impeller members 45*a*–45*g* located within the right zone 57 should have opposite screw directions 62*a* and 62*b* when the left zone 56 and the right zone 57 are located within opposite complementary halves 58*a* and 58*b* of the transverse dimension 59 of the frame 33*a*–33*b*, respectively.

Also preferably, the first blade member 60*a* and the second blade member 61*a* should have opposite screw directions with each other when they are located in opposite transverse half sides of the frame 33*a*–33*b*, respectively.

The left zone 56 defines a blade union including all of the blade members of the left-handed impeller members 44*a*–44*g* located within the left zone 56, and, preferably, the blade union should move the granular material passing through the left zone 56.

Also, preferably, the blade members of the left-handed impeller members 44*a*–44*g* located within the left zone 56 cooperate to move the granular material passing through the left zone 56 when the shaft member 42 is rotated about the axis of rotation 43.

Instead of the transferring means defined in paragraph (2) above, the semi-fluid based body support system of this embodiment can include the transferring means defined in a different manner, including:

(2A) means for transferring the granular material 31*a*–31*b* at an angle in the approximate range of 60° to 120° relative to the longitudinal axis 37 of the frame 33*a*–33*b*, wherein: the granular material 31*a*–31*b* are transferred in opposite transverse directions when they are located within opposite transverse half sides of the frame 33*a*–33*b*, respectively; the transfer direction of the transferring means is reversible; and the transferring means independently controls the transferring of the granular material 31*a*–31*b* at more than one location along the longitudinal dimension 50 of the frame 33*a*–33*b;* and (2B) means for transferring the granular material 31*a*–31*b* at an angle in the approximate range of 60° to 120° relative to the longitudinal axis 37 of the frame 33*a*–33*b,* wherein: a first granular material is transferred passing through the left zone 56 and a second granular material is transferred passing through the right zone 57; the transfer direction of the transferring means is reversible; and the transferring means independently controls the transferring of the granular material 31*a*–31*b* at more than one location along the longitudinal dimension 50 of the frame 33*a*–33*b.*

Figure 7:
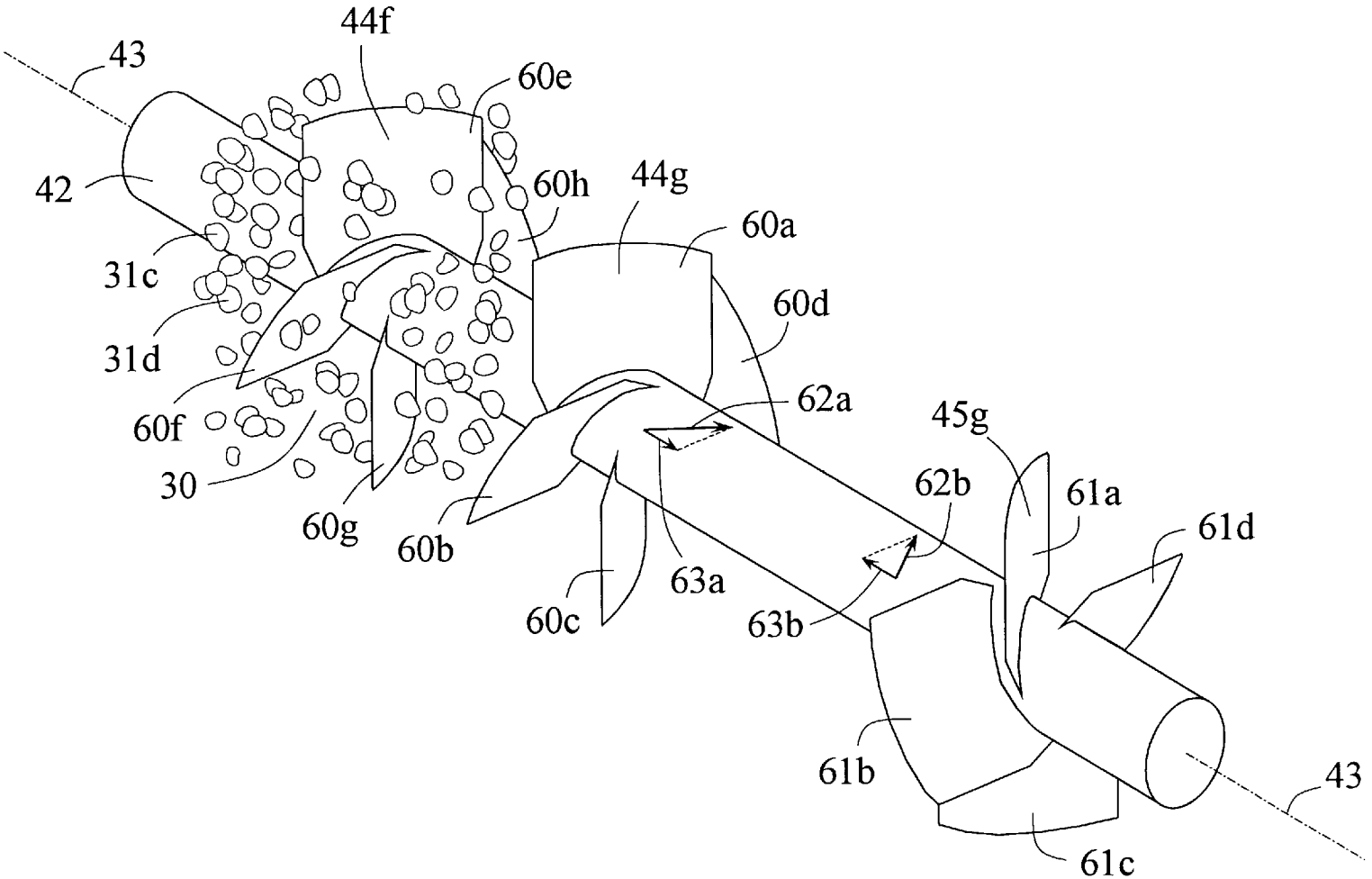
FIG. 7 is an enlarged partial perspective view of the rotary blade device within the granular material.

FIG. 7 illustrates the granular material 31*c* and 31*d* around the shaft member 42 and the left-handed impeller member 44*f.* Preferably, the blade area of the blade members 60*a*–60*h* should be much larger than the size of the granular material 31*c* and 31*d.*

Preferably, each of the rotary blade devices 32*a*–32*w* should further include means for rotating the shaft member 42 reversibly, as illustrated in FIGS. 3 and 5. Preferably, the rotating means should include a driving motor 41 connected to the shaft member 42.

The driving motor 41 rotates the left-handed impeller members 44*a*–44*g* and right-handed impeller members 45*a*–45*g* clockwise, counterclockwise and alternately clockwise and counterclockwise, through the shaft member 42. The alternate rotation of the impeller members 44*a*–44*g* and 45*a*–45*g* includes unbalanced rotation such as, for example, turning twice clockwise after turning once counterclockwise. Operation of each of the rotary blade devices 32*a*–32*w* is independently controlled, by the user, including the following operations: starting, stopping, direction of rotation and, preferably, speed of revolution. The user would be able to use some kind of remote control apparatus for controlling the rotary blade devices 32*a*–32*w.*

Each of the rotary blade devices 32*a*–32*w* is fixed to the base frame 33*a* by the bearing 46, seals 47*a*–47*b* and flange 48 of the driving motor 41 so that the shaft member 42 may be supported in the frame 33*a*–33*b* so as to be rotatable on the axis of rotation 43. Preferably, the rotary blade devices 32*a*–32*w* should be prepared severally (e.g., in groups) for each main region of the body including a head, shoulder, waist, hip, thigh and foot. Each installing space between the adjoining rotary blade devices 32*a,* 32*b* can be varied.

Preferably, to protect the machinery from a surge strain caused by the local pressure in the semi-fluid based body support system of this embodiment, a main portion of the shaft member 42 and the impeller members 44*a*–44*g* and 45*a*–45*g* should have a resilient structure or should be formed using elastic material such as a hard rubber component. Preferably, the mesh size of the safety net member 35 should be much larger than the size of the granular material 31*a*–31*b* so that the moving of the granular material 31*a*–31*b* may not be obstructed by the safety net member 35. The safety net member 35 covers the blade members of the impeller members 44*a*–44*g* and 45*a*–45*g.*

Preferably, the air permeable sheet 34 should have little tension and a big leeway to reject partial oppression caused by the tension of the air permeable sheet 34, as shown by wrinkles 36 illustrated in FIG. 1. If ventilation through the granular material 31*a*–31*b* is not important, an air impermeable sheet can be used instead of the air permeable sheet 34, and the granular material can be lubricated.

The term "fluidizing the granular material" as used herein is intended to represent flowing (or drifting) the granular material 31*a*–31*b* so that they may have some fluidity.

The term "transferring the granular material" as used herein is intended to represent moving (or transferring) the granular material so that the granular material may move from the departing location to the destination within the semi-fluid based body support system of this embodiment.

The term "accumulative height of the granular material" as used herein is intended to represent the vertical thickness of a mass of granular material 30 accumulated (or disposed) in the semi-fluid based body support system of this embodiment, at the point of measurement.

The term "transverse middle portion of the frame" as used herein is intended to represent generally a transverse portion of the frame 33*a*–33*b,* for supporting the user thereon. Usually, the user is supported in a middle portion of the frame. Therefore, generally, the term "transverse middle portion of the frame" as used herein is intended to represent a portion of the frame 33*a*–33*b,* wherein: a transverse dimension (i.e. a dimension measured in a transverse direction of the frame 33*a*–33*b*) of the portion is from 10% to 50%, preferably 20% to 40%, of the transverse dimension 59 of the frame 33*a*–33*b;* and the transverse center (i.e. a center measured in a transverse direction of the frame 33*a*–33*b*) of the portion is identical with the transverse center of the frame 33*a*–33*b.* The above-mentioned portion of the frame 33*a*–33*b* includes the space above the floor 39 of the frame 33*a*–33*b,* where the granular material resides.

The term "transverse side portion of the frame" as used herein is intended to represent either of the rest portions of the transverse middle portion of the frame.

Reduced Partial Oppression

Figure 8A:
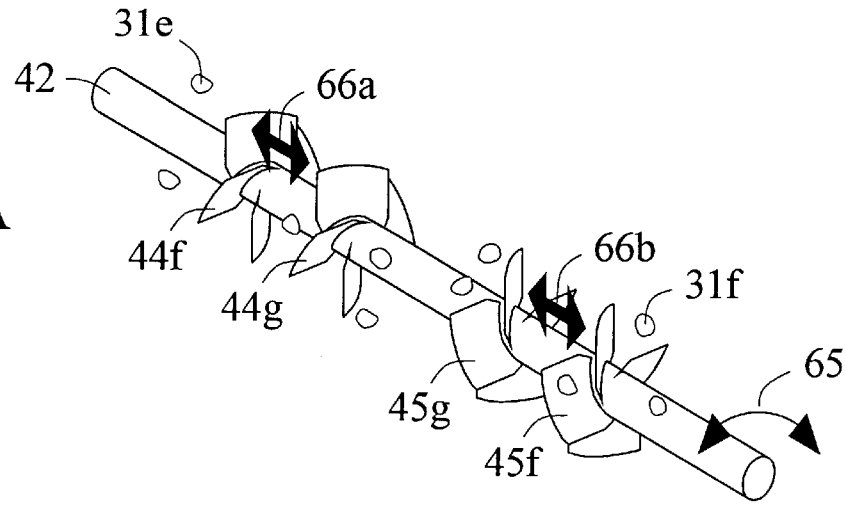
FIGS. 8A, 8B and 8C are partial perspective views of the rotary blade device operating on the granular material.

To reduce the partial oppression, the semi-fluid based body support system of this embodiment operates the rotary blade devices 32*a*–32*w* in a fluidizing mode as called herein so that the impeller members 44*a*–44*g* and 45*a*–45*g* may rotate alternately clockwise and counterclockwise as shown by an arrow 65, as illustrated in FIGS. 6 and 8A. The granular material 31*e* and 31*f* around the impeller members 44*a*–44*g* and 45*a*–45*g* is shaken (or stirred) as shown schematically by arrows 66*a* and 66*b* and gets local fluidity depending on the output power of the driving motor 41.

Figure 9A:
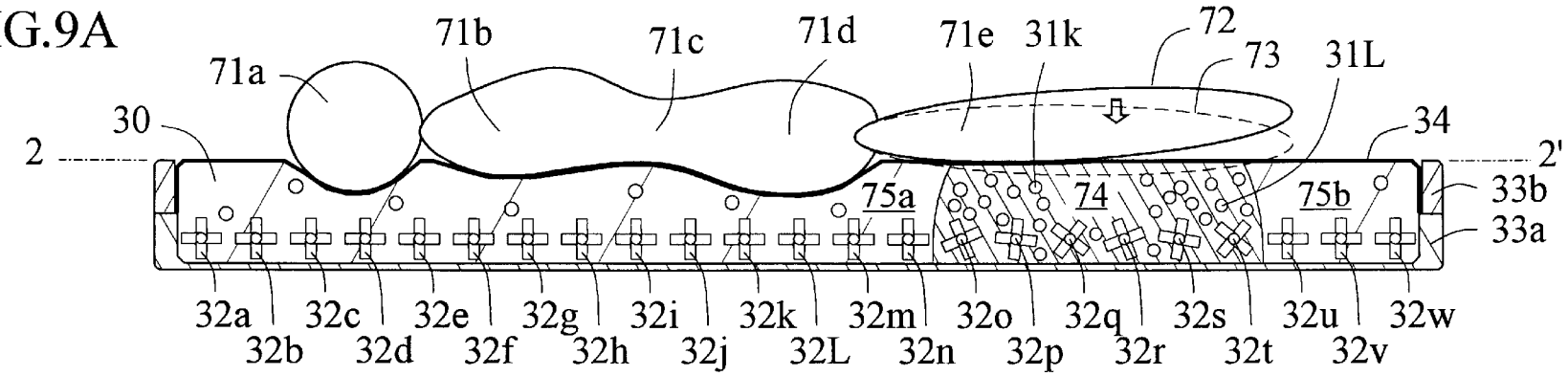
FIGS. 9A and 9B are vertical sectional views taken on line 2–2' of FIG. 1, schematically illustrating a condition of supporting the user.

As illustrated in FIG. 9A, if the user (head 71*a,* shoulder 71*b,* waist 71*c,* hip 71*d,* and leg 71*e*) feels the partial oppression at his leg region 71*e* in a current support condition 72, the user operates rotary blade devices 32*o*–32*t,* which correspond to leg region 71*e,* in the fluidizing mode. The driven granular material 31*k* and 31L in an area 74 around the rotary blade devices 32*o*–32*t* flows (or drifts) locally, like a fluid, in the semi-fluid based body support system of this embodiment, and the shape of this semi-fluid based body support system contacting the body changes to a new shape with reduced partial oppression at that area 74, due to the characteristics of the fluid. Thus, the user obtains a new support condition 73 with reduced partial oppression at the leg region 71*e.*

Within a period of the above operation, the granular material still remains in a stationary state at the surrounding area 75*a* and 75*b* of the other rotary blade devices 32*a*–32*n* and 32*u*–32*w* which are stationary or stopped. In the stationary state, since a mass of granular material 30 can support a load steadily in the shape presented, the other regions 71*a*–71*d* of the body continue to be supported steadily on the granular material while the above operation continues.

When the user gains a feeling of satisfaction about the partial oppression, the user stops all of the rotary blade devices 32*a*–32*w*. The semi-fluid based body support system of this embodiment thereafter supports the user steadily in the shape presented at the time of disabling the rotary blade devices. Thus, the semi-fluid based body support system of this embodiment can continue to support the body steadily in reduced partial oppression, if this semi-fluid based body support system has such a shape corresponding to reduced partial oppression, obtained through above-mentioned operation.

Fitness for Natural Posture

Figure 8B:
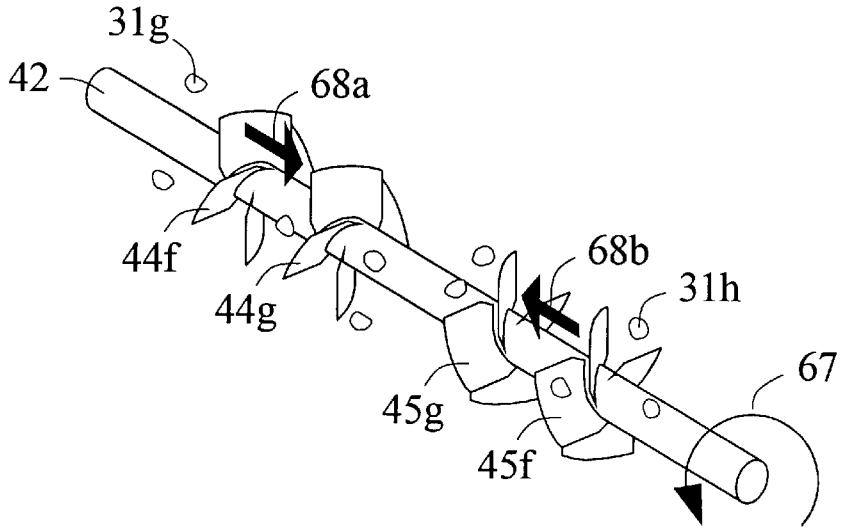
Figure 8C:
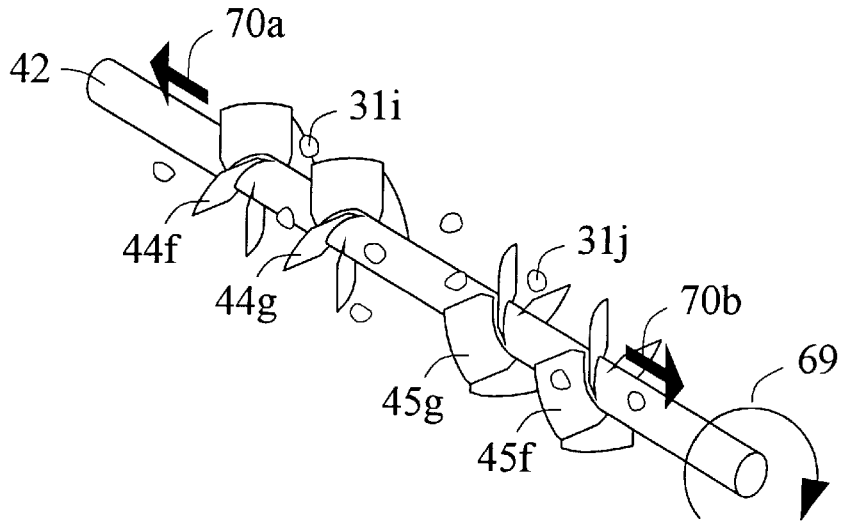

To fit the semi-fluid based body support system of this embodiment to the natural posture of the user, the semi-fluid based body support system of this embodiment operates the rotary blade devices 32*a*–32*w* in a transferring mode as called herein so that the impeller members 44*a*–44*g* and 45*a*–45*g* may rotate in a certain direction as shown by an arrow 67 or 69, as illustrated in FIGS. 8B and 8C. Because of a difference in weight (or specific gravity) of regions of the body, the user tends to have an unnatural posture when lying on a fluid or fluidized bed.

To compensate for deterioration of the posture, it is important to adjust a supporting height 52 for each region 51 of the body. As illustrated in FIG. 5, in the semi-fluid based body support system of this embodiment, the adjustment of the supporting height 52 is achieved by transferring the granular material 31 a between a transverse middle portion 54 and transverse side portions 55*a* and 55*b* of the frame 33*a*–33*b*.

Since each of the rotary blade devices 32*a*–32*w* has the left-handed impeller members 44*a*–44*g* located within the left zone 56 and the right-handed impeller members 45*a*–45*g* located within the right zone 57 as illustrated in FIGS. 5, 6 and 8C, the granular material 31*i* and 31*j* around the impeller members 44*a*–44*g* and 45*a*–45*g* is transferred from the transverse middle portion 54 to the transverse side portions 55*a* and 55*b* of the frame 33*a*–33*b* as shown schematically by arrows 70*a* and 70*b* when the impeller members 44*a*–44*g* and 45*a*–45*g* rotate clockwise viewing from the driving motor 41 as shown by an arrow 69.

By contrast, when the impeller members 44*a*–44*g* and 45*a*–45*g* rotate counterclockwise viewing from the driving motor 41 as shown by arrow 67 as illustrated in FIGS. 6 and 8B, the granular material 31*g* and 31*h* around the impeller members 44*a*–44*g* and 45*a*–45*g* is transferred from the transverse side portions 55*a* and 55*b* to the transverse middle portion 54 of the frame 33*a*–33*b* as shown schematically by arrows 68*a* and 68*b*.

The above-mentioned transferring of the granular material makes it possible to adjust the distribution of an accumulative height 53 of the granular material in the transverse middle portion 54 of the frame 33*a*–33*b*.

By independently controlling the rotary blade devices 32*a*–32*w* which are located along the longitudinal dimension 50 of the frame 33*a*–33*b*, it becomes possible to adjust a distribution of the accumulative height 53 of the granular material along the longitudinal dimension 50 of the frame 33*a*–33*b* at the transverse middle portion 54 of the frame 33*a*–33*b*. Since the transverse middle portion 54 of the frame 33*a*–33*b* generally corresponds to an area for supporting the user thereon, the above-mentioned adjustment of the granular material corresponds to an adjustment of the supporting height 52 in each region 51 of the body.

Figure 9B:
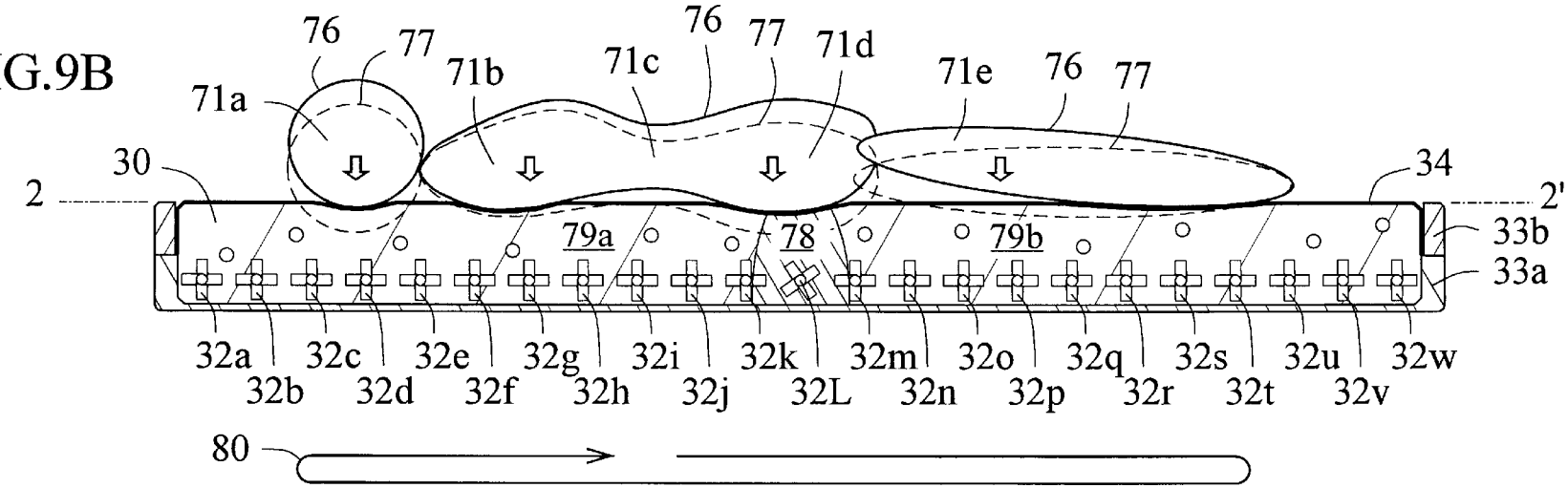
Figure 10A:
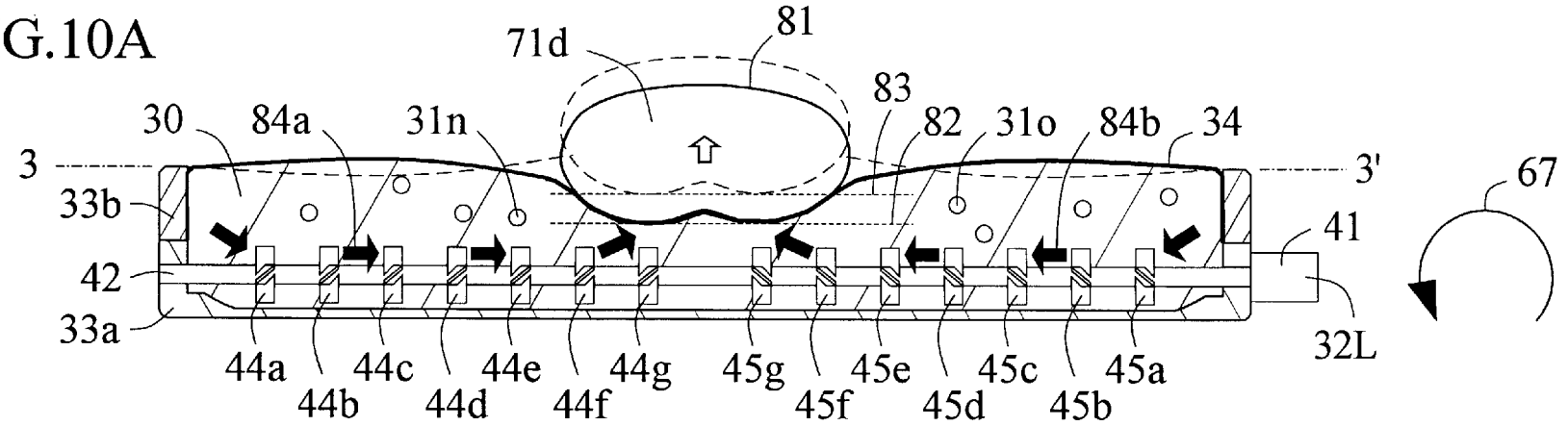
FIGS. 10A and 10B are vertical sectional views taken on line 3–3' of FIG. 1, schematically illustrating a condition of supporting the user.
Figure 10B:
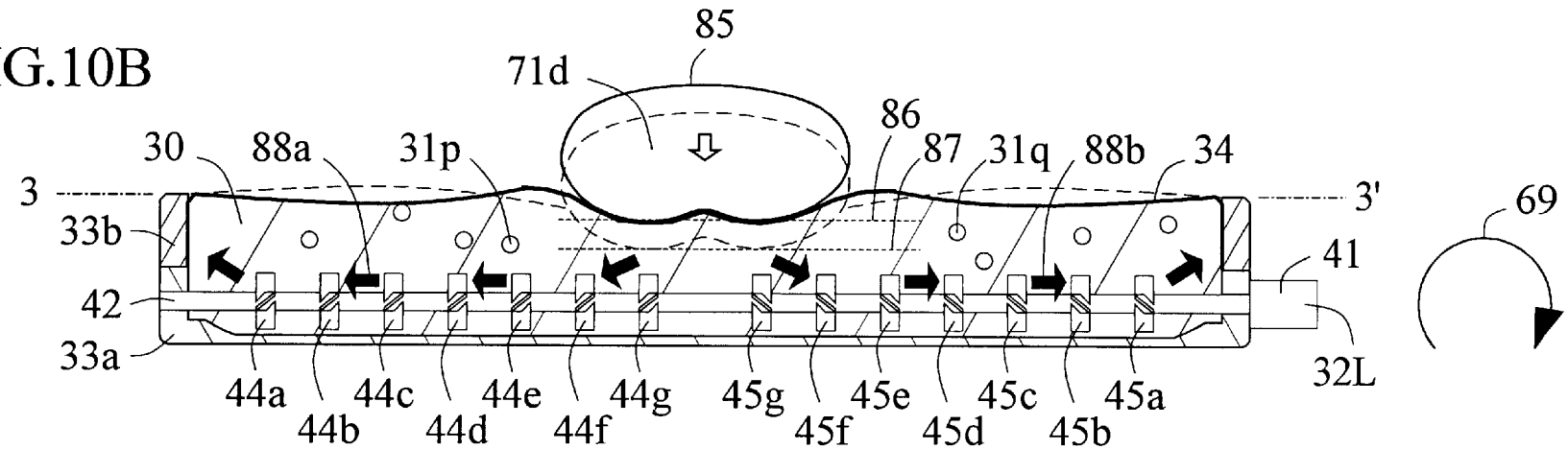

If the user feels something wrong, in the current posture 81 or 85, about the supporting height in his hip region 71*d*, the user operates a part of the rotary blade devices 32L corresponding to the hip region 71*d* in the transferring mode, as illustrated in FIGS. 10A, 10B and 9B.

FIG. 10A illustrates a case of lifting the hip region 71*d* from the current supporting height 82 to new supporting height 83 by transferring the granular material 31*n* and 31*o* from the transverse side portions 55*a* and 55*b* to the transverse middle portion 54 of the frame 33*a*–33*b*, as shown schematically by arrows 84*a* and 84*b*, by rotating the impeller members 44*a*–44*g* and 45*a*–45*g* of the rotary blade device 32L counterclockwise as shown by an arrow 67.

FIG. 10B illustrates a case of sinking down (or lowering) the hip region 71*d* from the current supporting height 86 to new supporting height 87 by transferring the granular material 31*p* and 31*q* from the transverse middle portion 54 to the transverse side portions 55*a* and 55*b* of the frame 33*a*–33*b*, as shown schematically by arrows 88*a* and 88*b*, by rotating the impeller members 44*a*–44*g* and 45*a*–45*g* of the rotary blade device 32L clockwise as shown by an arrow 69.

Thus, by applying the above-mentioned operation to each region of the body, the semi-fluid based body support system of this embodiment obtains fitness for natural posture.

Light Granular Material

In order to reduce the weight of the semi-fluid based body support system of this embodiment, it is appropriate to use light granular material. If the light granular material is used, the user tends to sink in this semi-fluid based body support system when the granular material is fluidized widely because the buoyancy operating on the body is insufficient to support the body.

A scanning control method, as called herein, of the rotary blade devices 32*a*–32*w* provides a narrow fluidized area of the granular material and a wide stationary area of the granular material before and behind the narrow fluidized area. The control method scans the narrow fluidized area along the body while supporting the user steadily on the wide stationary area.

As illustrated in FIG. 9B, if the user feels the partial oppression at all regions 71*a*–71*e* in the current support condition 76, the user needs to operate rotary blade devices 32*c*–32*t* corresponding to regions 71*a*–71*e*, in the fluidizing mode. In this case, if all of the above rotary blade devices 32*c*–32*t* are operated at a time, it is inevitable that the user suffers severe deterioration of posture caused by sinking of the whole body into the light granular material.

Accordingly, the user operates the required rotary blade devices 32*c*–32*t* one by one in turn, as shown by an arrow 80. In a narrow fluidized area 78 corresponding to the rotary blade device 32L which is operated currently, the shape of the semi-fluid based body support system of this embodiment changes to a new shape with reduced partial oppression by the flow of the granular material. Also, in the wide stationary areas 79*a* and 79*b* corresponding to the rotary blade devices 32*a*–32*k* and 32*m*–32*w* which are paused currently, the other regions of the body are supported steadily on the granular material. By scanning the narrow fluidized area 78 along all regions, the user obtains reduced partial oppression on the whole body at new support condition 77 without suffering severe deterioration of the posture.

By applying the scanning control method of the rotary blade devices 32*a*–32*w* to the operations in the fluidizing mode and in the transferring mode, the semi-fluid based body support system of this embodiment provides the user with a totally desirable effect on all of the regions while preventing the body from over sinking, even if a light granular material is used.

In the case of using a light granular material, preferably, the rotary blade devices should be rotated intermittently (or with periodical pulsed driving), especially when transferring the granular material. By the intermittent rotation of the rotary blade devices, the shortage of buoyancy is compensated to some extent due to the inertia of the body and granular material and some stability in an arrangement of a mass of granular material 30. In addition, the scanning control method of the rotary blade devices is also applicable to the case of using heavy granular material.

Mixture of Operation

In the above description, the operation for obtaining reduced partial oppression and the operation for obtaining fitness for natural posture are explained separately. But it is important to simultaneously apply these operations to the rotary blade devices 32*a*–32*w* to obtain reduced partial oppression and fitness for natural posture, moderately balanced. Preferably, these operations should be applied to each region of the body jointly, repeatedly and little by little, using an unbalanced rotation of the rotary blade devices 32*a*–32*w*, such as turning twice clockwise after turning once counterclockwise. The above unbalanced rotation of the rotary blade devices 32*a*–32*w* has a mixed effect on the operations of fluidizing and transferring the granular material. Thus, the user obtains reduced partial oppression and fitness for natural posture.

Installation to Bed

Figure 11:
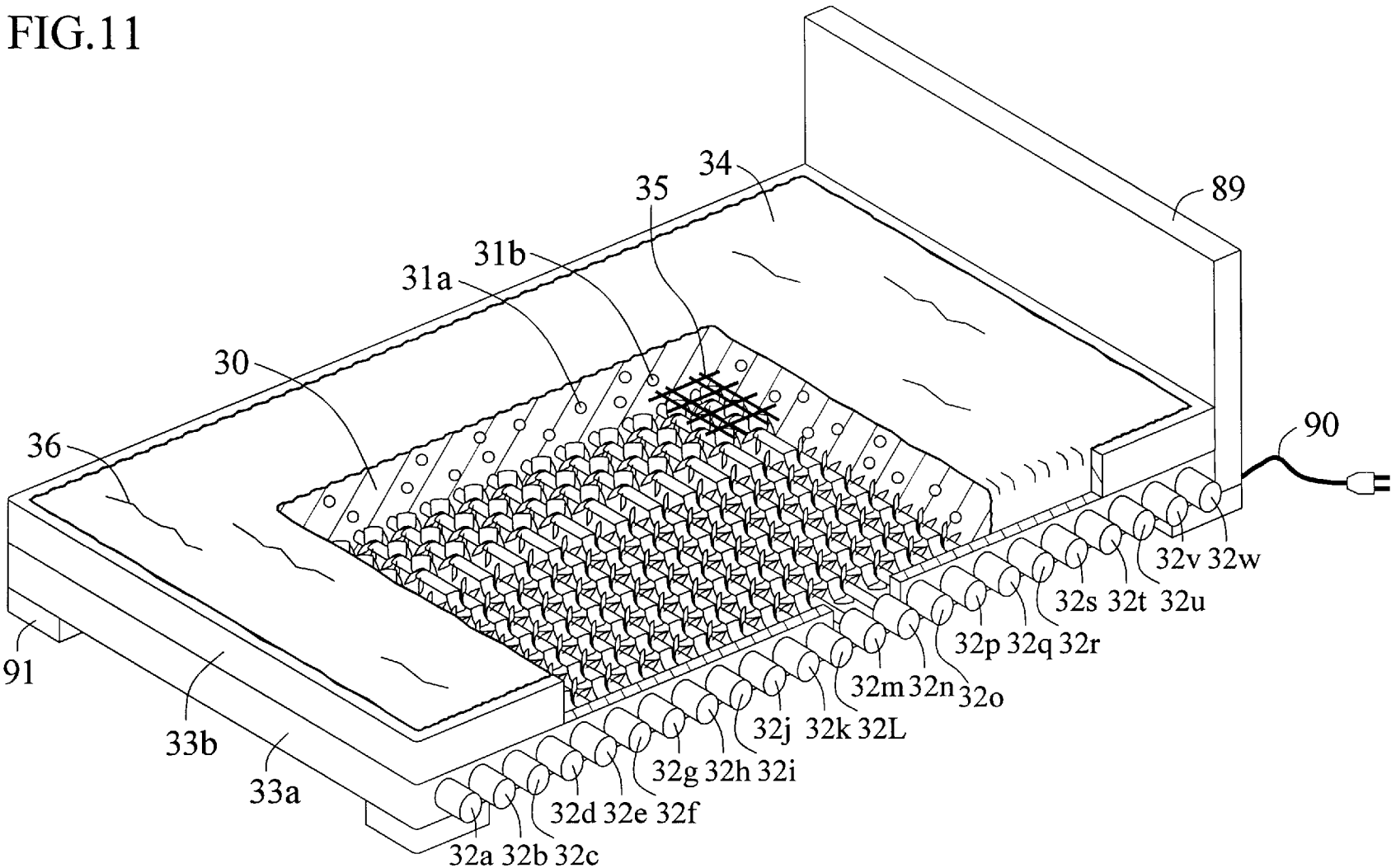
FIG. 11 is a partial cutaway perspective view of an example of a semi-fluid based body support system of the present invention, installed in a bed.

The semi-fluid based body support system of this embodiment can be installed in a bed so as to be separable or inseparable from the bed. FIG. 11 illustrates a bed mainly composed of the semi-fluid based body support system of this embodiment, a power control unit 89, a power line 90 and legs 91. The power control unit 89 is connected to the power line 90 and drives the rotary blade devices 32*a*–32*w* under the control of the user, preferably through some kind of remote control apparatus. The power control unit 89 can be composed mainly of an electronic circuit and heat sinks. In this case, the semi-fluid based body support system of this embodiment can have the power control unit 89 built-in by installing the heat sinks, for example, in the bottom face of the floor 39 of the frame 33*a*–33*b*.

Channel Structure

FIGS. 12 through 15 illustrate the second preferred embodiment of a semi-fluid based body support system of this invention. This embodiment further comprises a channel structure (or groove structure) in addition to being constructed like the first preferred embodiment, in order to localize the function area of the rotary blade devices 32*a*–32*w* and to strengthen the mechanical structure. The channel structure is composed of channels 100*a*–100*w* generally arranged in parallel. The term "channel" as used herein is intended to represent a linear area of relatively deep portions.

Figure 12:
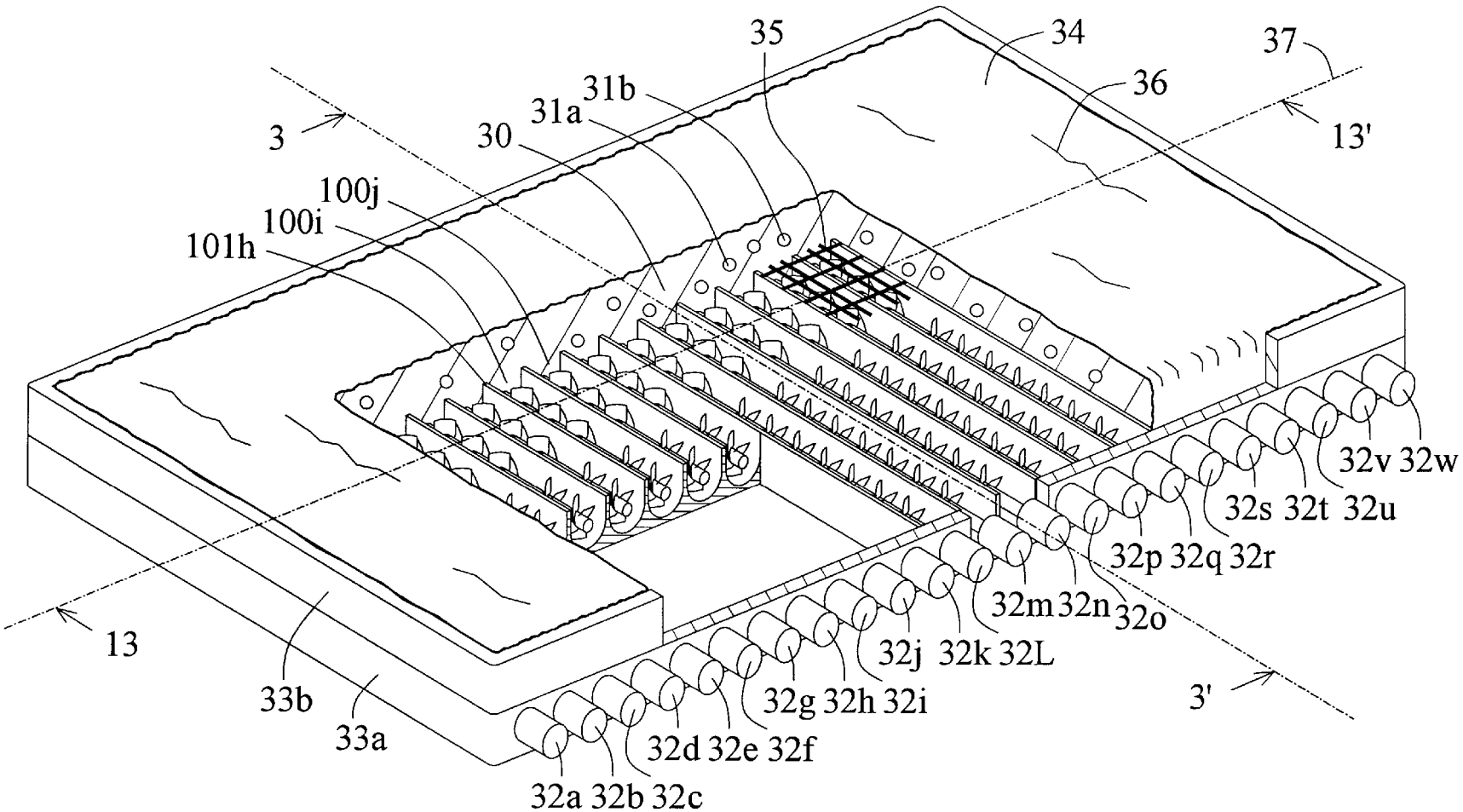
FIG. 12 is a partial cutaway perspective view of the other preferred embodiment of a semi-fluid based body support system of the present invention.
Figure 13:
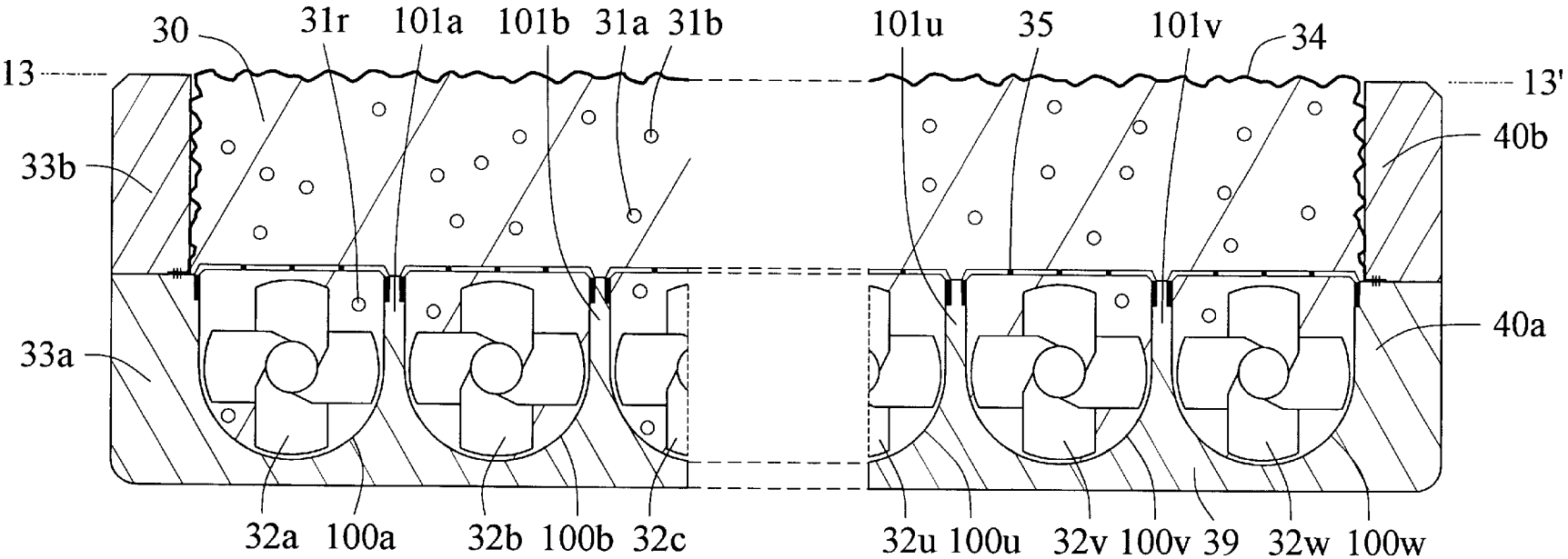
FIG. 13 is a partial vertical sectional view taken on line 13–13' of FIG. 12.

The floor 39 of the frame 33*a*–33*b* has channels 100*a*–100*w* formed on a top face of the floor 39, as illustrated in FIGS. 12 and 13. The channel 100*a* houses (or receives) the corresponding rotary blade device 32*a* at least partially. Thus the channel 100*a* is oriented at an angle in the approximate range of 60° to 120° relative to the longitudinal axis 37 of the frame 33*a*–33*b*, and the channels 100*a*–100*w* are located, preferably arranged, along the longitudinal dimension 50 of the frame 33*a*–33*b*. The shaft member 42 of the rotary blade device 32*a* is rotatable on the axis of rotation 43 generally parallel to the corresponding channel 100*a*.

Preferably, every channel 100*a*–100*w* should support the safety net member 35 to improve the strength of the safety net member 35. By connecting the safety net member 35 to the walls 101*u* and 101*v* of the channel 100*v*, it is possible to release the load on the safety net member 35 and it also becomes easy to cover the blade member of the rotary blade device 32*v* by the safety net member 35 to protect the user.

Preferably, the vertical depth 170*a*, 170*b* and 170*c* of the channels 100*c*, 100*x* and 100*y* should be equal to or greater than an external radius of rotation 103R (i.e. half of the external diameter, shown with a circle 103) of the blade member of the impeller members 44*g* of the rotary blade devices 32*c*, as illustrated in FIGS. 14A, 14B, 14C and 14D. Since the wall 101*a* of the channel 100*a* controls the longitudinal moving of the granular material 31*r* toward the next channel 100*b* as illustrated in FIG. 13, the function area of the rotary blade device 32*a* is localized, so that the independent controllability in each region of the body is improved.

Figure 14A:
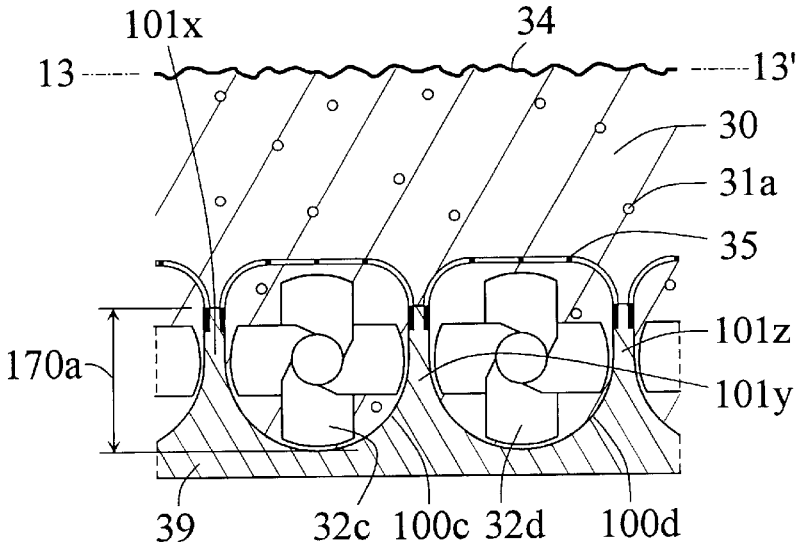
FIGS. 14A, 14B, 14C and 14D are partial vertical sectional views taken on line 13–13' of FIG. 12, illustrating channels and the rotary blade devices.
Figure 14B:
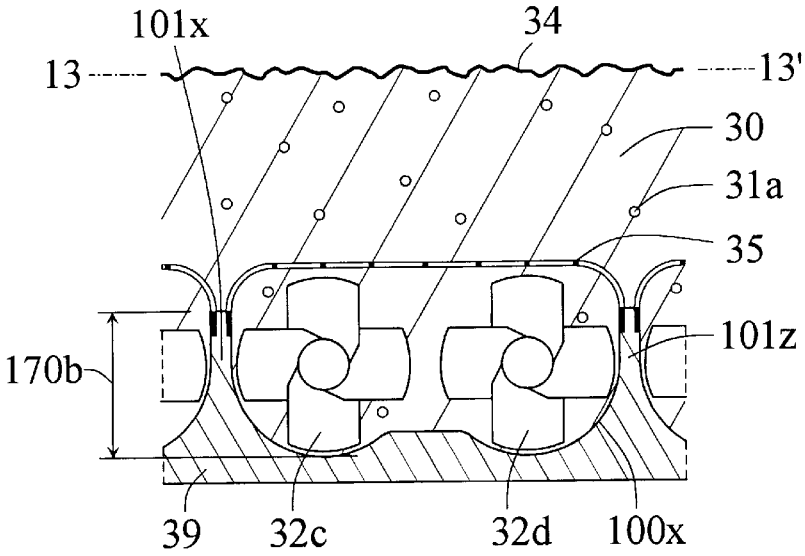
Figure 14C:
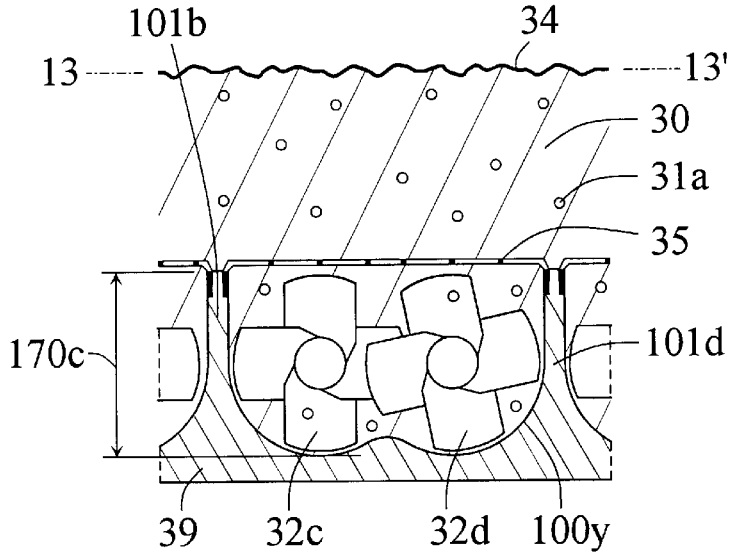

The height of the walls 101*a*–101*v* and 101*x*–101*z* of the channels can vary severally depending on the characteristics of the granular material and/or on the regions of the body, as illustrated in FIGS. 13, 14A and 14B. Also, two or more rotary blade devices 32*c* and 32*d* can be placed in the same channel 100*x*, as illustrated in FIG. 14B. As illustrated in FIG. 14C, the function areas of the adjoining rotary blade devices 32*c* and 32*d* placed in the same channel 100*y* can overlap with each other by shifting the mounting positions of the impeller members on the shaft member 42.

Figure 14D:
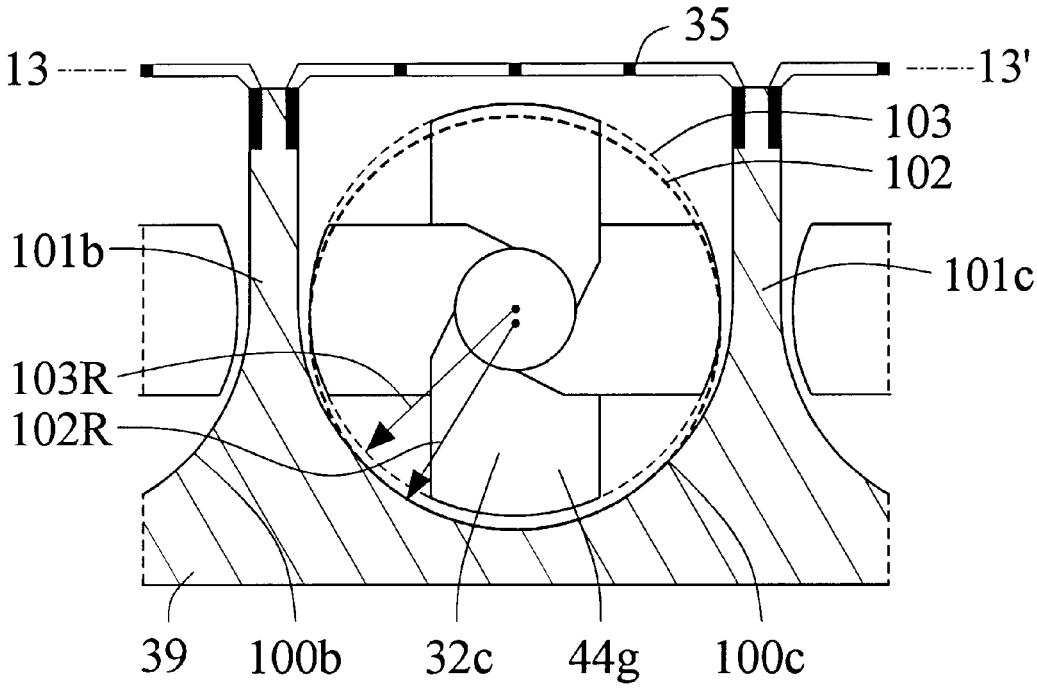

As illustrated in FIG. 14D, in order to support the rotary blade device 32*c* when the shaft member 42 is deflected by a lateral load, preferably, the inner surface of the channel 100*c* should share the lateral load like a bearing for the impeller member 44*g*. Therefore, preferably, the radius of curvature 102R (i.e. half of the core diameter, shown with a circle 102) of the inner surface of the channel 100*c* should be substantially equal to an external radius of rotation 103R of the impeller members 44*a*–44*g* and 45*a*–45*g* at least in its bottom portion. Normally, the rotary blade device 32*c* is apart from the inner surface of the channel 100*c*. They contact when the shaft member 42 is deflected, and the inner surface of the channel 100*c* supports the rotary blade device 32*c*. Lateral load is also supportable by using ordinary bearings for extra support of the shaft member 42.

A direction of a channel can be curved or bent, if necessary. In the curved channel, divided shaft members, flexible joints and extra bearings for the shaft member are available for the rotary blade device.

Figure 15:
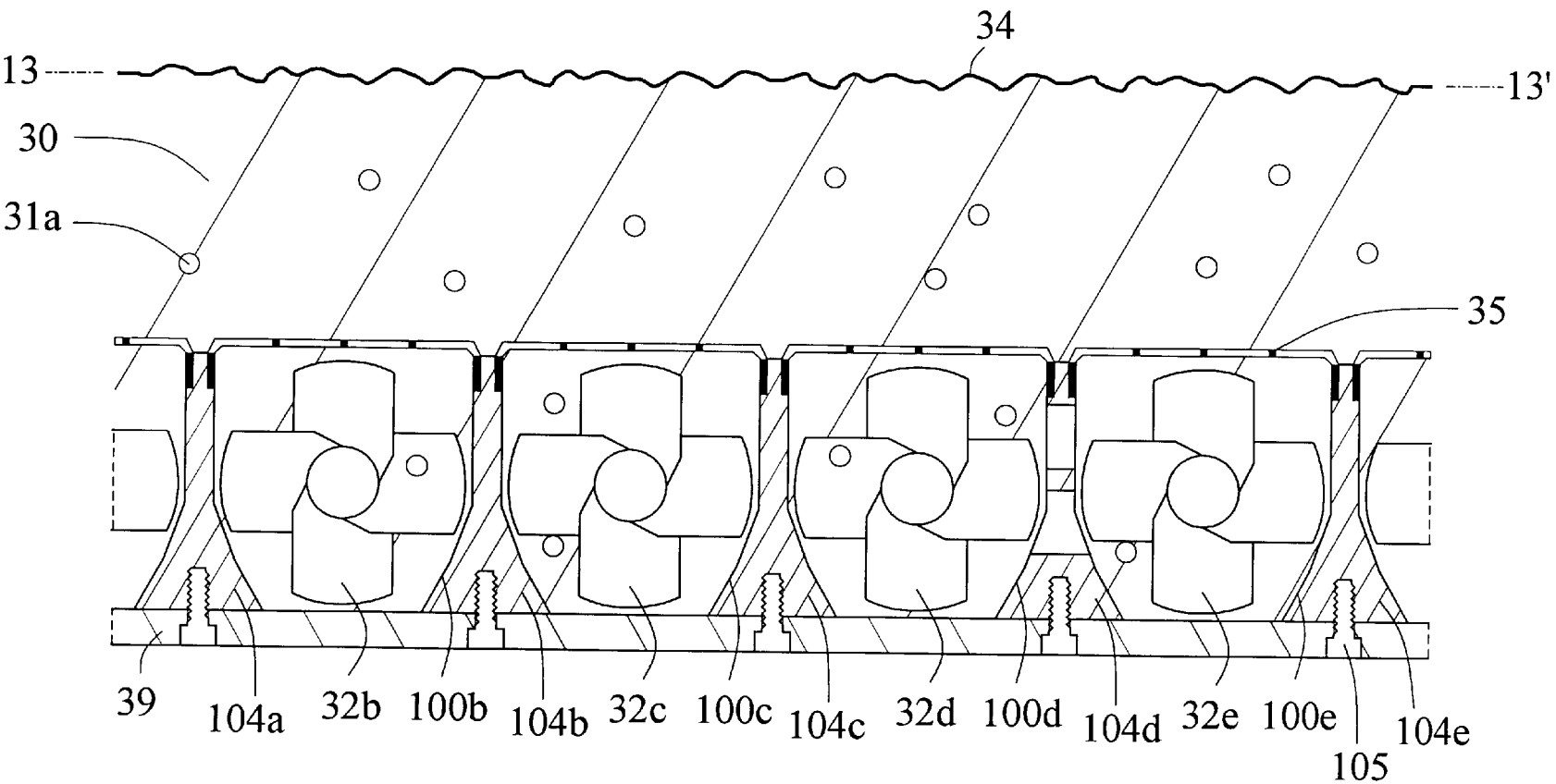
FIG. 15 is a partial vertical sectional view similar to FIG. 13, illustrating partitions and the rotary blade devices.

As illustrated in FIG. 15, the channel structure having channels 100*b*–100*e* can be also formed by partitions 104*a*–104*e* supported in the frame 33*a*–33*b*. The partition 104*a* functions like the wall 101*a* of channels 100*a* and 100*b*. The partitions 104*a*–104*e* are fixed to the floor 39 of the frame 33*a*–33*b* by the bolts 105.

The partition 104*b* is located between the adjoining rotary blade devices 32*b* and 32*c*. Thus, the partitions 104*a*–104*e* are oriented at an angle in the approximate range of 60° to 120° relative to the longitudinal axis 37 of the frame 33*a*–33*b* and are located, preferably arranged, along the longitudinal dimension 50 of the frame 33*a*–33*b*. The shaft member 42 of the rotary blade device 32*a* is rotatable on the axis of rotation 43 generally parallel to the direction of the corresponding partition 104*b*. The partition 104*d* can have holes, if necessary.

Preferably, the vertical height of the partition 104*b* should be equal to or greater than an external radius of rotation 103R of the blade member of the impeller members 44*a*–44*g* and 45*a*–45*g*. The vertical height of the partition 104*b*, as used herein, is defined as a height of the top of the partition 104*b* measured from the bottom of the impeller members of the rotary blade devices 32*b* and 32*c*.

Cell Structure

Figure 16:
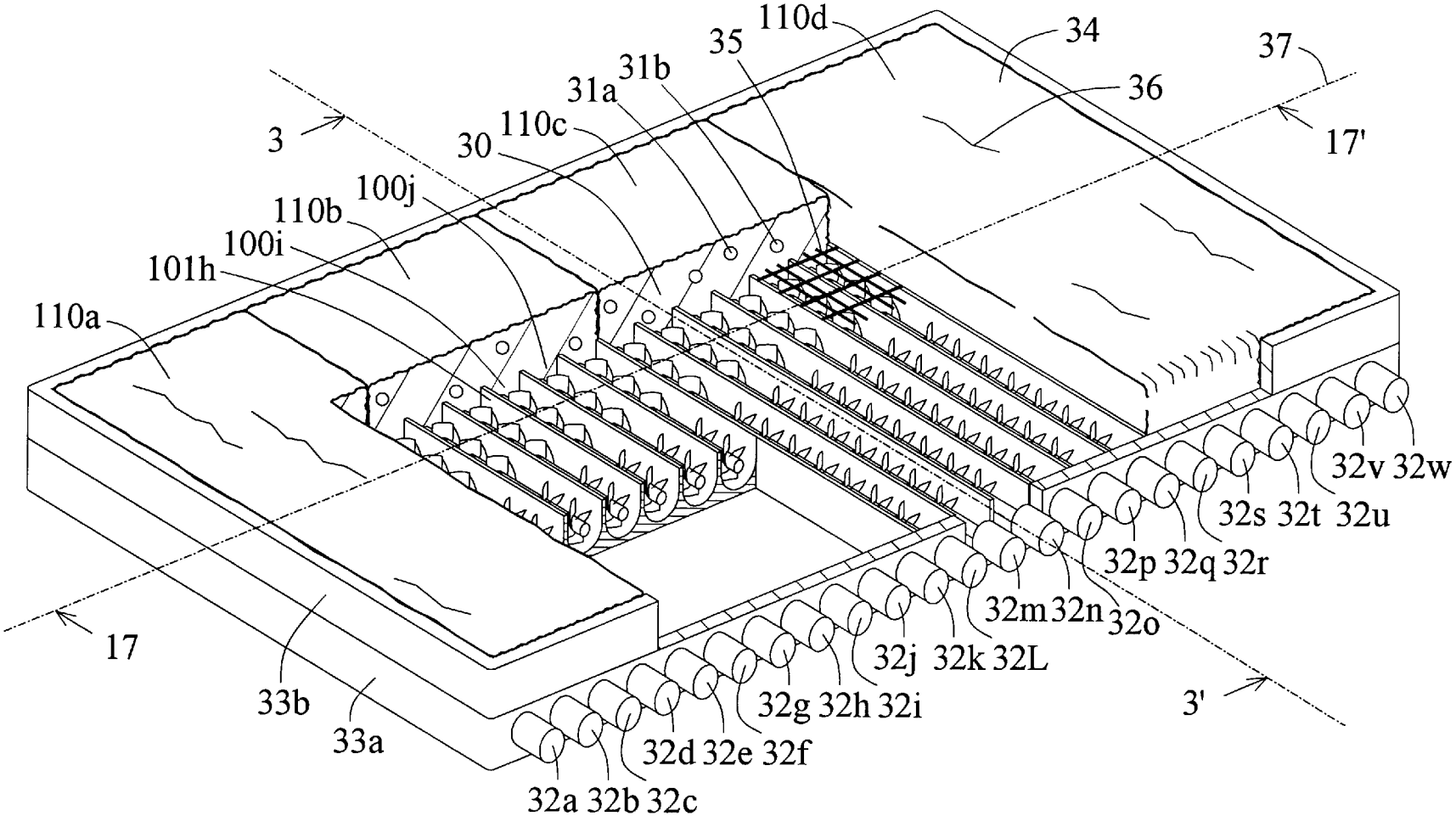
FIG. 16 is a partial cutaway perspective view of another preferred embodiment of a semi-fluid based body support system of the present invention.
Figure 17A:
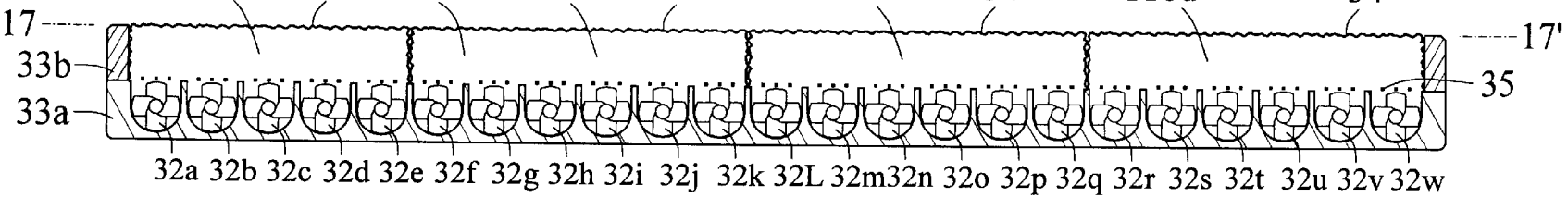
FIG. 17A is a schematic vertical sectional view taken on line 17–17' of FIG. 16.
Figure 17B:
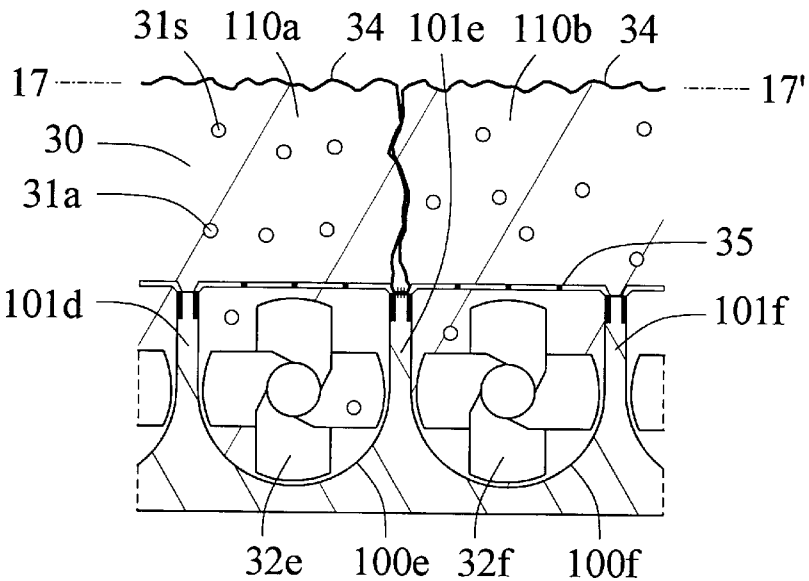
FIG. 17B is a partial vertical sectional view taken on line 17–17' of FIG. 16, illustrating the channels.
Figure 18:
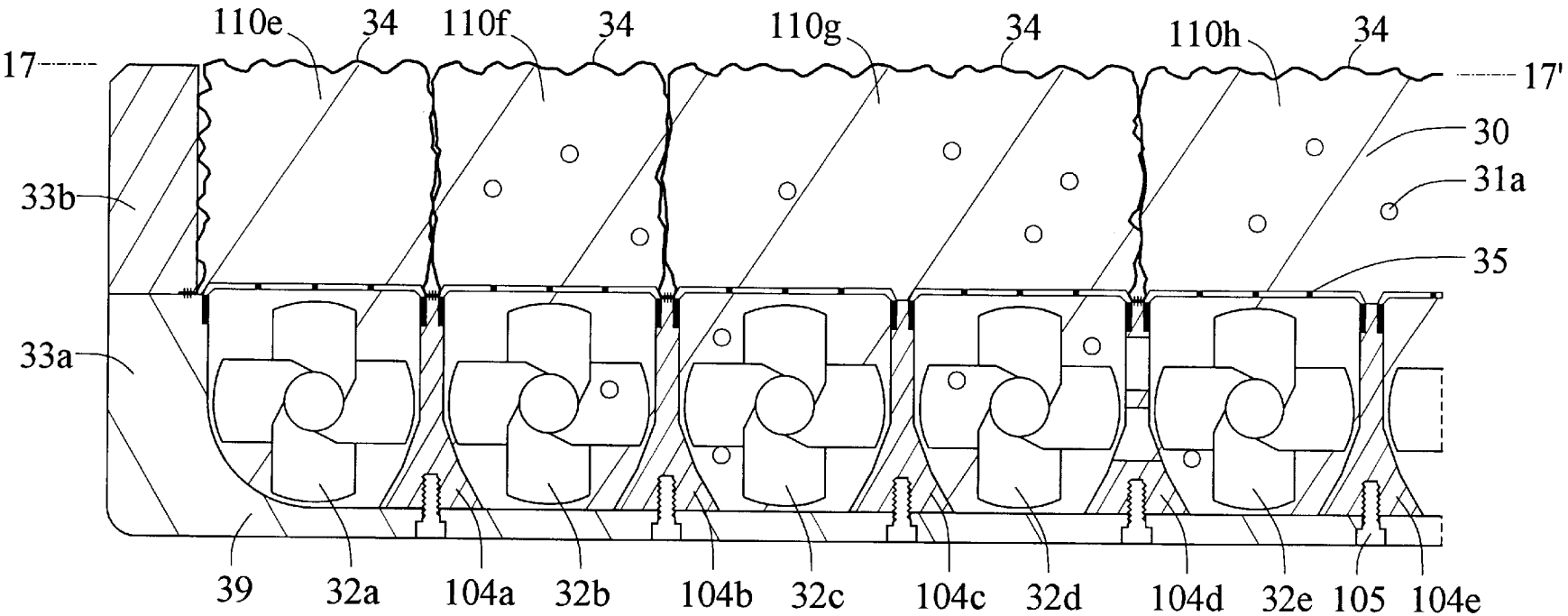
FIG. 18 is a partial vertical sectional view similar to FIG. 17B, illustrating the partitions.

FIGS. 16 through 18 illustrate the third preferred embodiment of a semi-fluid based body support system of this invention. This embodiment comprises a cell structure in addition to being constructed like the second preferred embodiment, to lessen the trouble in making a bed (e.g., provide a more rapid adjustment of the system to the user) and to improve the feel of this semi-fluid based body support system. The cell structure is composed of cells 110*a*–110*d* arranged in the frame 33*a*–33*b* longitudinally.

As illustrated in FIGS. 17A and 17B, the frame 33*a*–33*b* and the air permeable sheet 34 are further connected to the wall 101*e* of the channel 100*e* and define a cell 110*a* surrounded thereby. Each of the cells 110*a*–110*d* holds a part of a mass of granular material 30. Since a longitudinal migration (or drift) of the granular material 31*s* is restricted to inside of the cell 110*a*, it lessens the trouble in making a bed (e.g., the system may be rapidly adjusted to a user) which is usually required in the advance of medical preparations or in the turning of the body. The characteristics of the granular material held in each of the cells 110*a*–110*d* can vary severally to improve the feel of this semi-fluid based body support system.

As illustrated in FIG. 18, the partitions 104*a*–104*e* supported in the frame 33*a*–33*b* can be used for the cell structure. In this case, the frame 33*a*–33*b* and the air permeable sheet 34 are connected to the partitions 104*b* and 104*d* and define a cell 110*g* surrounded thereby. Each of the cells 110*e*–110*h* holds a part of a mass of granular material 30. One or more rotary blade devices 32*c* and 32*d* can be placed within the cell 110*g*. Also, the adjoining cells 110*g* and 110*h* can be connected through the holes of the partition 104*d*.

Single-Ended Rotary Blade Device

Figure 19A:
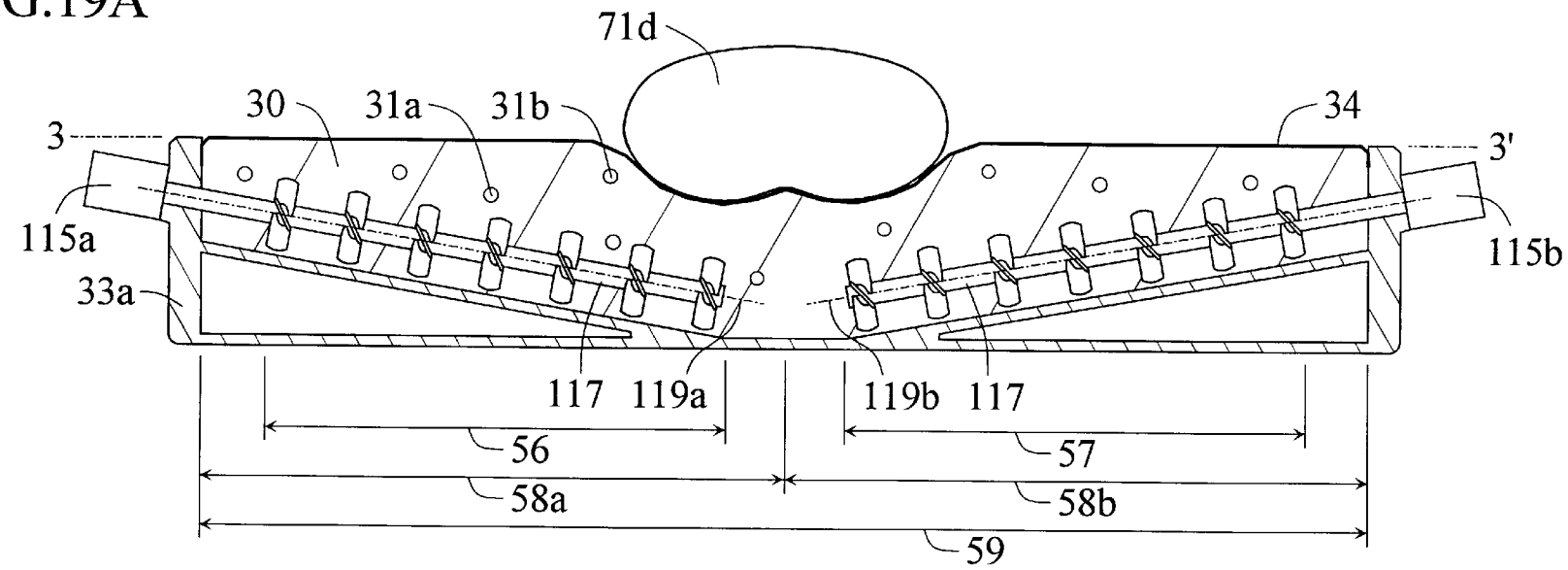
FIG. 19A is a schematic vertical sectional view, similar to FIG. 5, of yet another preferred embodiment of a semi-fluid based body support system of the present invention.
Figure 19B:
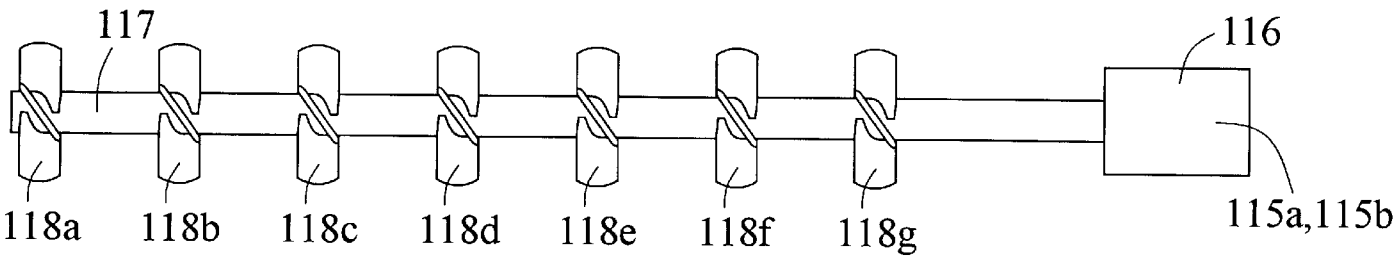
FIG. 19B is an elevational view of a single-ended rotary blade device.

FIGS. 19A and 19B illustrate the fourth preferred embodiment of a semi-fluid based body support system of this invention. This embodiment comprises single-ended rotary blade devices 115*a* and 115*b* instead of the rotary blade devices 32*a*–32*w* of the first preferred embodiment.

Each of the single-ended rotary blade devices 115*a* and 115*b* includes a shaft member 117 and right-handed impeller members 118*a*–118*g* connected to the shaft member 117, as illustrated in FIG. 19B. The driving motor 116 is connected to the shaft member 117 so as to rotate the right-handed impeller members 118*a*–118*g* clockwise, counterclockwise, and alternately clockwise and counterclockwise. Operation of each of the single-ended rotary blade devices 115*a* and 115*b* is independently controlled, by the user, including the following operations: starting, stopping, direction of rotation and, preferably, speed of revolution. The single-ended rotary blade devices 115*a* and 115*b* are installed in the frame 33*a* so that an axis of rotation 119*a* and 119*b* of the shaft member 117 may be oriented at an angle in the approximate range of 60° to 120° relative to a longitudinal axis 37 of the frame 33*a*. Preferably, the single-ended rotary blade devices 115*a* and 115*b* face each other and should be used as a pair.

The vertical directions of the axes of rotation 119*a* and 119*b* of the single-ended rotary blade devices 115*a* and 115*b* can vary with each other, as illustrated in FIG. 19A. Also, the horizontal directions of the axes of rotation 119*a* and 119*b* of the single-ended rotary blade devices 115*a* and 115*b* can vary with each other.

The operations of the single-ended rotary blade devices 115*a* and 115*b* are similar to those of the rotary blade devices 32*a*–32*w* in the first preferred embodiment. For example, clockwise rotation of the rotary blade devices 32*a*–32*w* in the first preferred embodiment corresponds to the same clockwise rotation of the single-ended rotary blade devices 115*a* and 115*b*. Each of the rotary blade devices 32*a*–32*w* in the first preferred embodiment include left-handed impeller members 44*a*–44*g* located within the left zone 56 and right-handed impeller members 45*a*–45*g* located within the right zone 57, while the single-ended rotary blade devices 115*a* and 115*b* include right-handed impeller members 118*a*–118*g* located within left zone 56 and right zone 57, respectively. The user can improve the handling of this semi-fluid based body support system by driving each of the single-ended rotary blade devices 115*a* and 115*b* independently.

A pair of the single-ended rotary blade devices 115*a* and 115*b*, facing each other transversely, can be connected by a flexible joint and be driven by a common driving motor, if the screw directions of their impeller members (i.e. screw direction in left zone 56 and screw direction in right zone 57) are opposite each other. The rotary blade devices 32*a*–32*w* of the first preferred embodiment can be divided into three or more pieces, if necessary.

Blade and Guide

FIGS. 20A, 20B, 20C and 21 illustrate the other preferred embodiments of the rotary blade device and related components. Although the rotary blade devices 32*a*–32*w* are applied to both of the fluidizing means and the transferring means, each blade member of the rotary blade devices 32*a*–32*w* can have a biased feature suitable for either fluidizing means or transferring means. Therefore, the blade shape, blade area, blade angle, blade inclination, blade eccentricity and blade linkage can vary in every blade member.

Figures 20A, 20B, 20C, 20D:
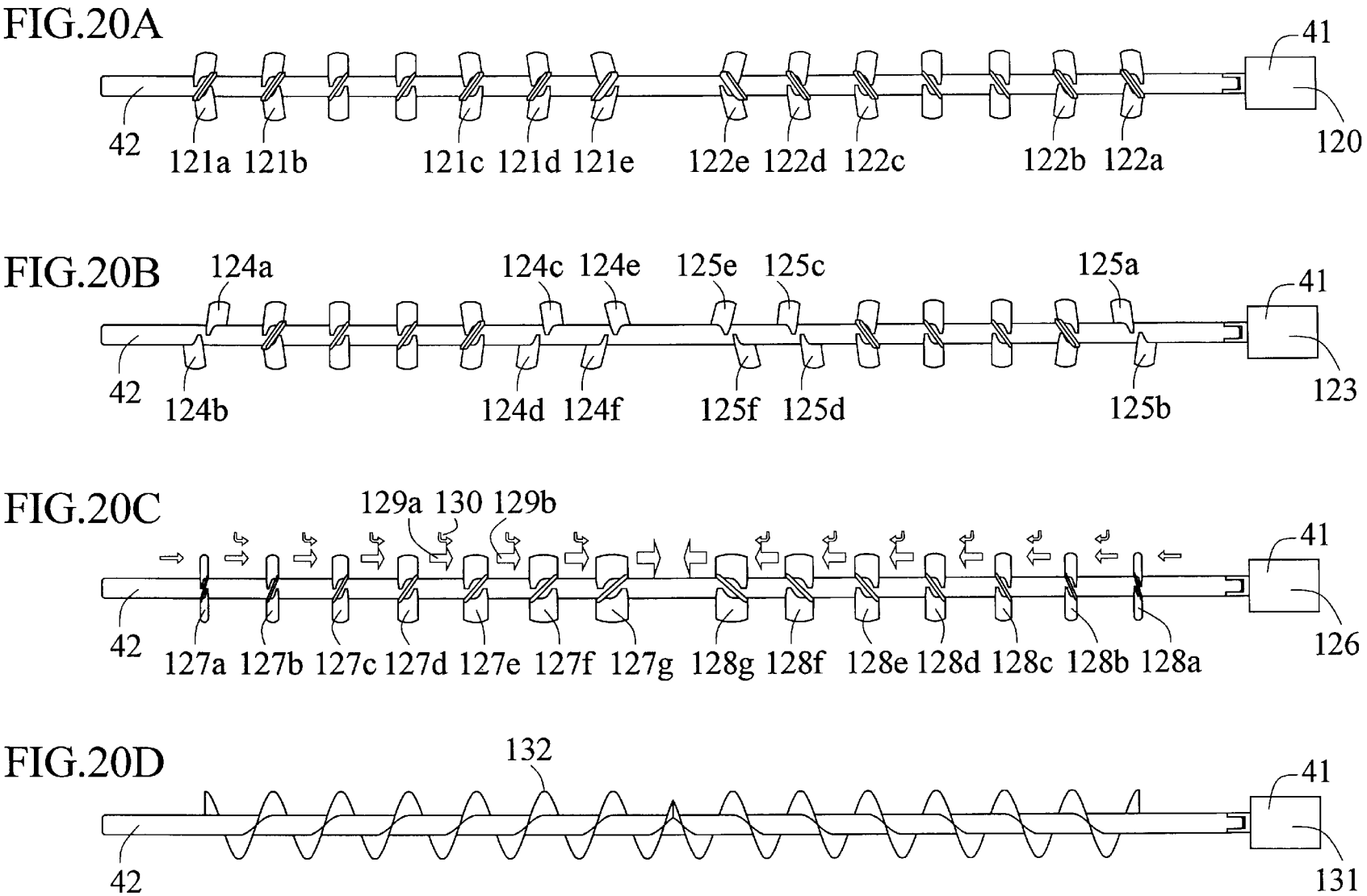
FIGS. 20A, 20B and 20C are elevational views of other preferred embodiments of the rotary blade device.
FIG. 20D is an elevational view of another example of the rotary blade device.

FIG. 20A illustrates a rotary blade device 120 having left-handed inclined impeller members 121*a*–121*e* and right-handed inclined impeller members 122*a*–122*e* so as to have mixed effects in fluidizing and transferring the granular material 31*a*–31*b*.

FIG. 20B illustrates a rotary blade device 123 having left-handed inclined and eccentric sole blade members 124*a*–124*f* and right-handed inclined and eccentric sole blade members 125*a*–125*f* so as to strengthen the effect in fluidizing the granular material 31*a*–31*b*.

FIG. 20C illustrates a rotary blade device 126 having left-handed impeller members 127*a*–127*g* and right-handed impeller members 128*a*–128*g*, wherein the blade angle of the inner impeller member 127*e* (i.e. impeller member located at an inner position on the shaft member 42) is larger than the blade angle of the outer impeller member 127*d*. The transportable quantity 129*b* of the inner impeller member 127*e* with a relatively large blade angle is larger than the transportable quantity 129*a* of the outer impeller member 127*d* with a relatively small blade angle. Thus, distributions of quantities of the granular material carried out or carried in within the transverse side portions 55*a* and 55*b* of the frame 33*a*–33*b* can be made relatively uniform due to the movement of granular material pushed out from, or drawn into, the array of the impeller members 127*a*–127*g* and 128*a*–128*g*, as shown by arrows 130.

A particularly shaped blade member partially including the above-mentioned features is available, if necessary. An example of such a particularly shaped blade member is a screw-like transferring blade partially having a kneading blade thereon. FIG. 20D illustrates a rotary blade device 131 having a continuous screw blade member 132 as a simple example of the particularly shaped blade member.

Figure 21:
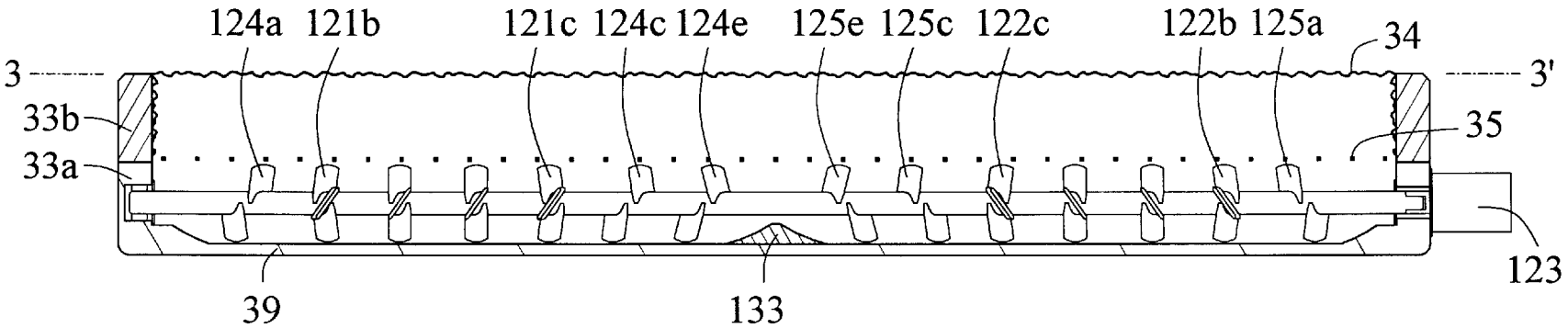
FIG. 21 is a schematic vertical sectional view similar to FIG. 5, illustrating a guide slope.

As illustrated in FIG. 21, preferably, a guide slope 133 should be used in the transverse center of the frame 33*a*–33*b*, to assist the function of the blade members.

Mirror Symmetrical Arrangement

Figure 22:
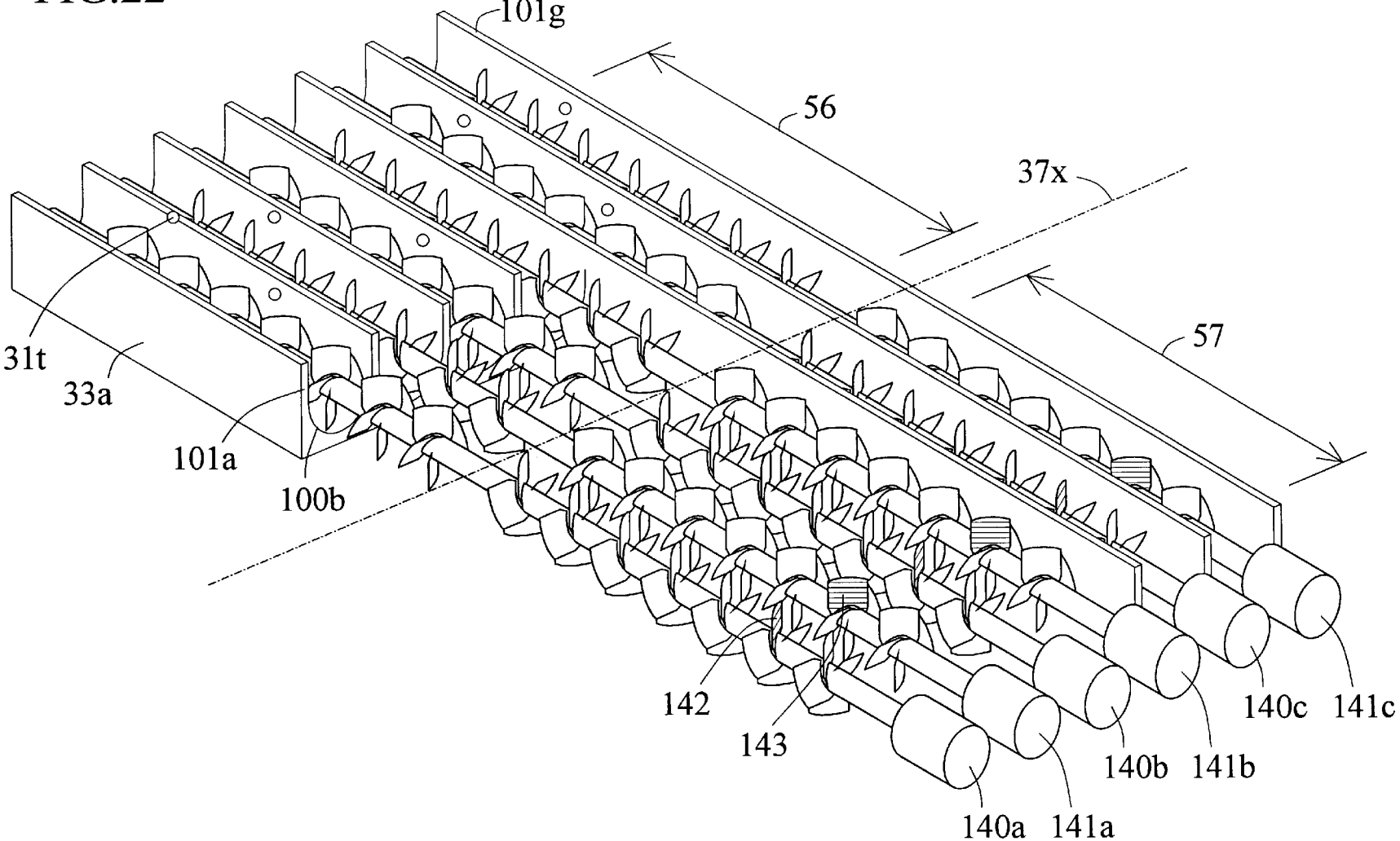
FIG. 22 is a perspective view of adjoining mirror symmetrical rotary blade devices.

FIGS. 22, 23A, 23B and 24 illustrate another preferred embodiment of arrangements of the rotary blade devices and its blade members. If many rotary blade devices 140*a*–140*c* and 141*a*–141*c* rotate in the same direction, the granular material 31*t* located above the channel 100*b* tends to migrate (or drift) in a longitudinal direction 37*x* of the frame 33*a*–33*b* because the granular material 31*t* is pushed in that direction 37*x* continuously by the blade members 142 and 143, as illustrated in FIG. 22.

To compensate for the above migration, the adjoining rotary blade devices 140*a* and 141*a* have substantially mirror symmetrical screw directions with each other in the longitudinal direction 37*x* of the frame 33*a*–33*b*, in an arrangement of their blade members 142 and 143. These adjoining longitudinally mirror symmetrical rotary blade devices 140*a* and 141*a* as called herein can be placed in the same channel as a pair of rotary blade devices, as similarly illustrated in FIG. 14B.

Figure 23A:
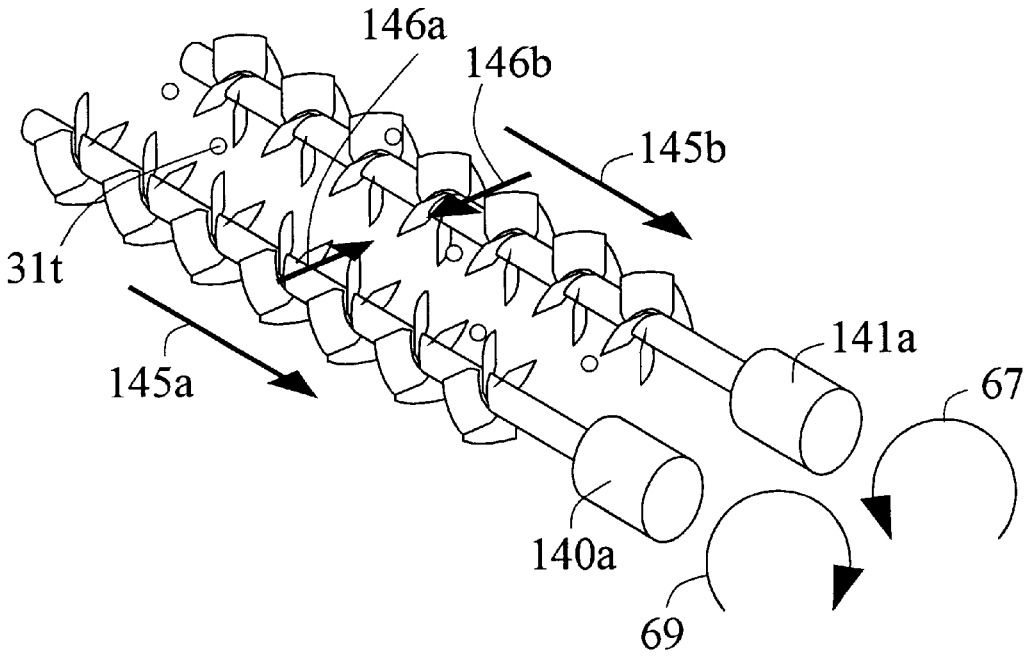
FIGS. 23A and 23B are partial perspective views of the adjoining mirror symmetrical rotary blade devices operating on the granular material.

As illustrated in FIG. 23A, when the adjoining longitudinally mirror symmetrical rotary blade devices 140*a* and 141*a* transfer the granular material 31*t* from the transverse middle portion 54 to the transverse side portion 55*b* of the frame 33*a*–33*b* (or reversibly) as shown by arrows 145*a* and 145*b*, these adjoining rotary blade devices 140*a* and 141*a* rotate in opposite directions with each other as shown by arrows 69 and 67. Therefore, the longitudinal migration of the granular material 31*t* is canceled to some extent as shown by arrows 146*a* and 146*b*.

Figure 23B:
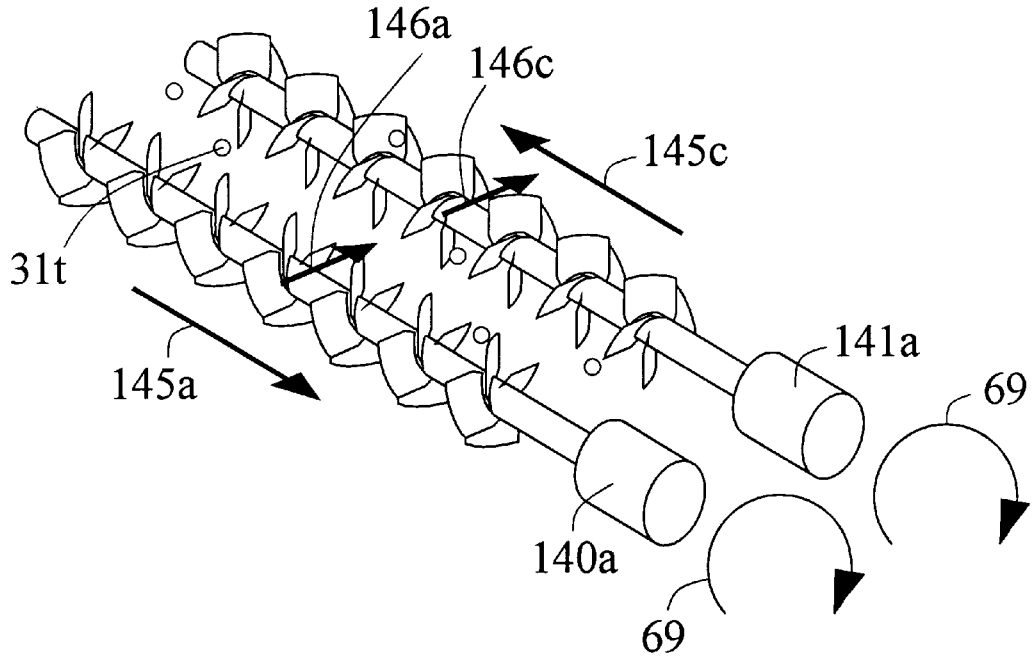

By contrast, when the adjoining longitudinally mirror symmetrical rotary blade devices 140*a* and 141*a* rotate in the same direction as shown by an arrow 69, the granular material 31*t* circulates relatively transversely as shown by arrows 145*a* and 145*c* and migrates longitudinally as shown by arrows 146*a* and 146*c* as illustrated in FIG. 23B. In this case, the longitudinal migration of the granular material 31*t* is intensified.

Canceling or intensifying of the longitudinal migration of the granular material lessens further the trouble in making a bed (e.g., accelerates the rate of adjustment of the system to a user).

Figure 24:
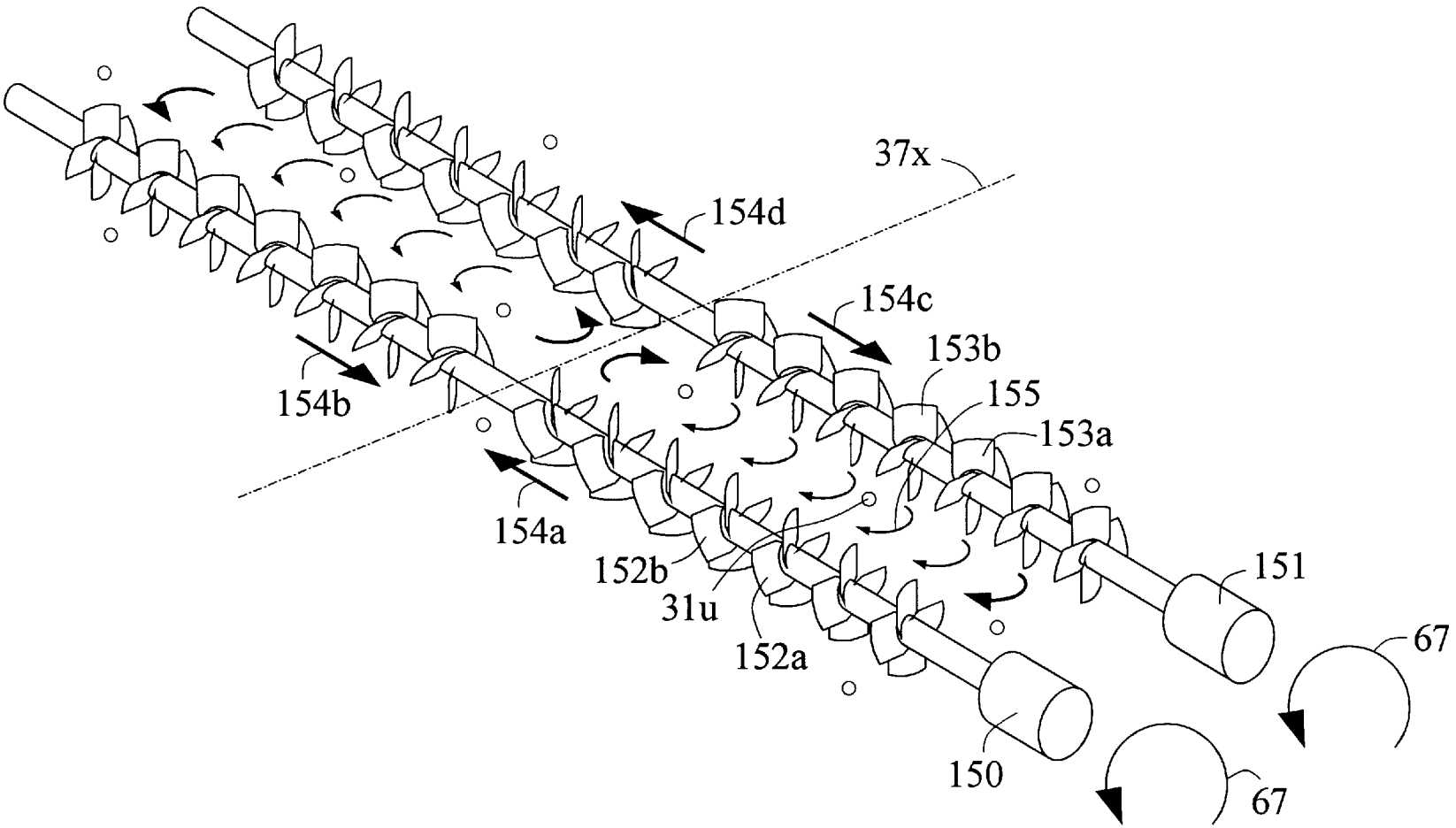
FIG. 24 is a perspective view of the adjoining mirror symmetrical rotary blade devices operating on the granular material.

FIG. 24 illustrates adjoining longitudinally mirror symmetrical rotary blade devices 150 and 151, wherein the blade angle of the inner impeller member of these rotary blade devices 150 and 151 is larger than the blade angle of the outer impeller member of these devices, as similarly illustrated in FIG. 20C. When these rotary blade devices 150 and 151 are rotated in the same direction as shown by an arrow 67, the granular material 31*u* tends to swirl between the adjoining rotary blade devices 150 and 151 as shown by arrows 154*a*–154*d* and 155 since the transportable quantity of the blade members 153*a* and 153*b* are different. Thus, the effect in fluidizing the granular material is improved.

Granular Material

Preferably, the granular material should have low specific heat and low thermal conductivity to reduce the thermal disharmony. Preferably, the granular material should have sizes ranging from 1 millimeter (mm) to 3 millimeters (mm) to provide the strength, feel and ventilation. Preferably, the granular material should be hard and slippery. Preferably, the granular material should have a variety of shapes and sizes so that a mass of granular material 30 may have appropriate stability or instability in an arrangement thereof.

Furthermore, desirably, the granular material should have a little elasticity so as to follow slight movements of the user, such as breathing.

A synthetic resin is applicable to the granular material to simplify its production. The hollow structured granular material is used to reduce the weight of this semi-fluid based body support system.

Ventilation for Airlines

Figure 25A:
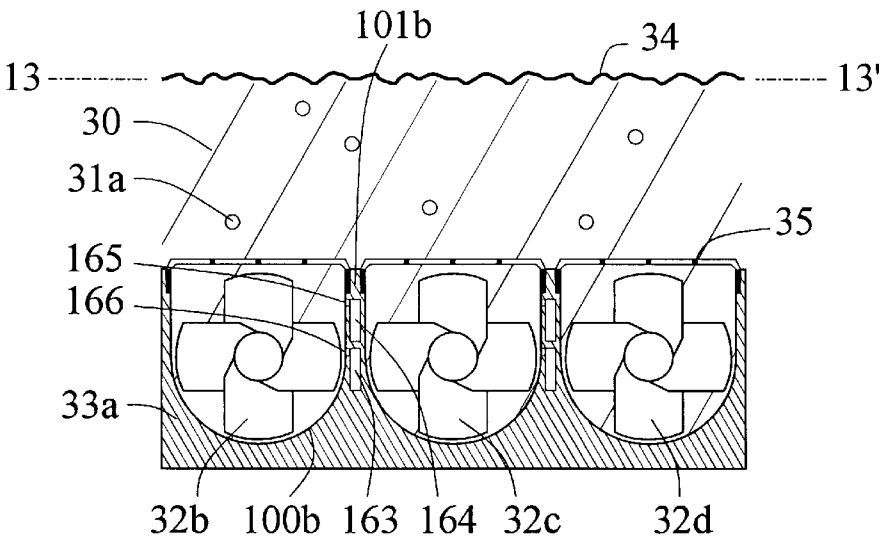
FIG. 25A is a partial vertical sectional view similar to FIG. 13, illustrating air ducts.
Figure 25B:
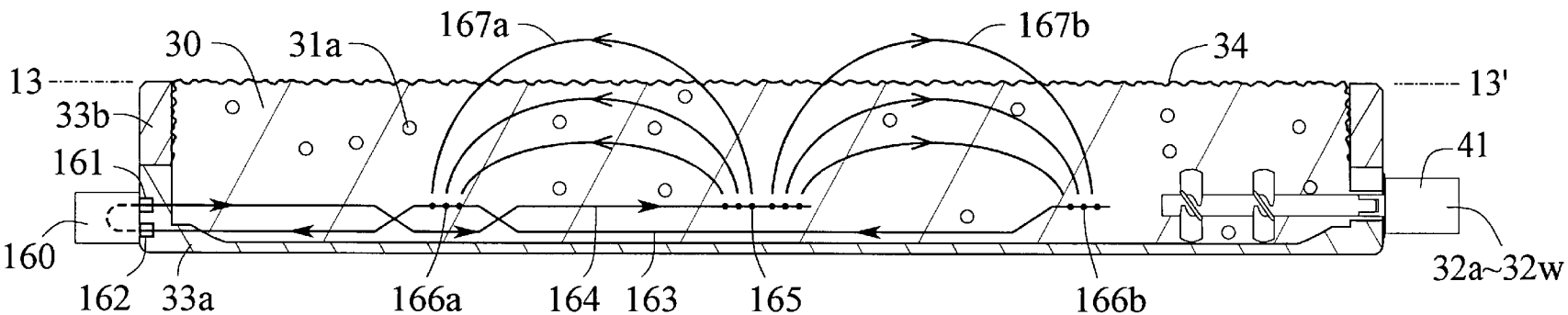
FIG. 25B is a schematic vertical sectional view similar to FIG. 5, illustrating air current for ventilation.

FIGS. 25A and 25B schematically illustrate a preferred embodiment of an air circulating apparatus for a semi-fluid based body support system of this invention. The air circulating apparatus mainly circulates the air transversely through this semi-fluid based body support system.

An air pump 160 having an intake port 162 and an outlet port 161 is installed in the frame 33*a*–33*b*, as illustrated in FIG. 25B. An inhaling duct 163 and an exhaling duct 164 are placed along the channel 100*b*, and are preferably formed within a wall 101*b* of the channel 100*b*. The inhaling duct 163 and the exhaling duct 164 are connected to the intake port 162 and the outlet port 161 of the air pump 160, respectively. Air permeable inhaling holes 166, 166*a* and 166*b* are placed on the inhaling duct 163 and air permeable exhaling holes 165 are placed on the exhaling duct 164. The air permeable inhaling holes 166, 166*a* and 166*b* and the air permeable exhaling holes 165 are exposed to the granular material 31*a* respectively.

To make the air currents 167*a* and 167*b* transversely circulate through the air permeable sheet 34 and the granular material 31*a*, the air permeable inhaling holes 166, 166*a* and 166*b* are located in the transverse side portions of the frame 33*a*–33*b* and the air permeable exhaling holes 165 are located in the transverse middle portion of the frame 33*a*–33*b*, as illustrated in FIG. 25B.

By driving the air pump 160, the user obtains good ventilation by the air currents 167*a* and 167*b* which circulate from the back of the user to both sides of this semi-fluid based body support system transversely. Instead of the air permeable sheet 34, an air impermeable sheet with an air permeable area in its middle portion is available to keep the air warm by suppressing air leakage from the sheet side portions while the air circulates.

It should also be understood that the foregoing relates to only preferred embodiments of the invention, and that it is intended to cover all changes and modifications of the examples of the invention herein chosen for the purpose of the disclosure, which do not constitute departures from the spirit and scope of the invention.

What is claimed is:

1. A body support system comprising:

(a) a frame having a floor and a wall;

(b) a mass of granular material disposed in said frame for supporting said body; and (c) an adjustment mechanism having a fluidizing device to selectively alter a state of said granular material between fluid and stationary states and a transferring device to selectively distribute said granular material to particular sections within said frame by transferring said granular material reversibly between said particular frame sections to adjust said granular material to conform to said supported body.

2. The body support system of claim 1 further comprising:

(d) a safety net member connected to said wall of said frame.

3. A body support system comprising:

(a) a frame having a floor and a wall;

(b) a mass of granular material disposed in said frame for supporting said body; and (c) an adjustment mechanism to selectively alter a state of said granular material between fluid and stationary states and to selectively distribute said granular material to particular sections within said frame to adjust said system to conform to said supported body, wherein said adjustment mechanism includes:

a fluidizing device to fluidize said granular material, said fluidizing device independently controlling said fluidizing of said granular material at more than one location along a longitudinal dimension of said frame; and a transferring device to transfer said granular material reversibly between a transverse middle portion and transverse side portions of said frame, said transferring device independently controlling said transferring of said granular material at more than one location along said longitudinal dimension of said frame.

4. The body support system of claim 3 wherein said fluidizing device and said transferring device jointly comprise:

at least two material manipulation devices supported by said frame, said material manipulation devices being located along said longitudinal dimension of said frame, and each of said material manipulation devices including:

a shaft member rotatable about an axis of rotation;

a blade assembly connected to said shaft member; and a rotation mechanism to rotate said shaft member reversibly, wherein selective rotation of said shaft member facilitates said fluidization and transference of said granular material.

5. The body support system of claim 4 wherein said shaft member axis of rotation is oriented at an angle in a range of 60° to 120° relative to a longitudinal axis of said frame.

6. The body support system of claim 4 wherein said rotation mechanism includes a driving motor connected to said shaft member.

7. The body support system of claim 4 wherein said blade assembly is in the form of an impeller member.

8. The body support system of claim 4 wherein said blade assembly includes a first blade member arranged on said shaft member within a first zone disposed between a central longitudinal axis of said frame and a first transverse side of said frame, said first zone having a transverse dimension which is at least 25% of a transverse dimension of said frame.

9. The body support system of claim 8 wherein said first blade member has a uniform screw direction within said first zone.

10. The body support system of claim 9 wherein said blade assembly further includes a second blade member arranged on said shaft member within a second zone disposed on a side of said central longitudinal axis opposite said first zone, wherein said second blade member has a uniform screw direction within said second zone, and wherein said screw direction of said first blade member is opposite said screw direction of said second blade member.

11. The body support system of claim 4 wherein each of said devices includes a plurality of blade assemblies arranged on said shaft member within a zone disposed between a central longitudinal axis of said frame and a transverse side of said frame, wherein said zone has a transverse dimension which is at least 25% of a transverse dimension of said frame, and wherein said blade assemblies cooperate to move granular material passing through said zone when said shaft member is rotated about said axis of rotation.

12. The body support system of claim 4 wherein said floor has a channel on an upper side of said floor, and said channel houses one of said devices at least partially.

13. The body support system of claim 12 wherein a vertical depth of said channel is greater than an external radius of rotation of said blade assembly of said one device.

14. The body support system of claim 4 further including:

a partition supported in said frame between adjoining material manipulation devices and having a vertical height greater than an external radius of rotation of each adjoining material manipulation device blade assembly.

15. A body support system comprising:

(a) a frame having a floor and a wall;

(b) a mass of granular material disposed in said frame for supporting said body; and (c) an adjustment mechanism to selectively alter a state of said granular material between fluid and stationary states and to selectively distribute said granular material to particular sections within said frame to adjust said system to conform to said supported body, wherein said adjustment mechanism includes:

at least two devices supported by said wall, said devices being located at spaced locations along a longitudinal dimension of said frame, and each of said devices includes:

a shaft member rotatable about an axis of rotation;

a blade member connected to said shaft member; and a rotation mechanism to rotate said shaft member reversibly, wherein selective rotation of said shaft member facilitates said state alteration and distribution of said granular material.

16. The body support system of claim 15 wherein said shaft member axis of rotation is oriented at an angle in a range of 60° to 120° relative to a longitudinal axis of said frame; and said blade member has a subtantially uniform screw direction within a zone located between a central longitudinal axis of said frame and a transverse side of said frame, wherein a transverse dimension of said zone is greater than 25% of a transverse dimension of said frame.

17. A body support system comprising:

(a) a frame having a floor and a wall;

(b) a mass of granular material disposed in said frame for supporting said body; and (c) at least two devices supported by said frame, said devices being located at spaced locations along a longitudinal dimension of said frame, and each of said devices including:

a shaft member rotatable about an axis of rotation;

a blade member connected to said shaft member; and a rotation mechanism to rotate said shaft member reversibly, wherein rotation of said shaft member manipulates said granular material within said frame to selectively adapt said system to said supported body.

18. The body support system of claim 17 wherein:

said shaft member axis of rotation is oriented at an angle in a range of 60° to 120° relative to a longitudinal axis of said frame; and said blade member has a substantially uniform screw direction within a zone disposed between a central longitudinal axis of said frame and a transverse side of said frame, wherein a transverse dimension of said zone is larger than 25% of a transverse dimension of said frame.

19. A body support system comprising:

(a) a frame having a floor and a wall, said frame defining a zone on one side of a central longitudinal axis of said frame;

(b) a mass of granular material disposed in said frame for supporting said body;

(c) a fluidizing device to fluidize said granular material, said fluidizing device independently controlling said fluidizing of said granular material at more than one location along a longitudinal dimension of said frame; and (d) a transferring device for transferring said granular material in a direction oriented at an angle in a range of 60° to 120° relative to a longitudinal axis of said frame, said transferring device reversibly moving said granular material passing through said zone, and said transferring device independently controlling said transferring of said granular material at more than one location along said longitudinal dimension of said frame.

20. The body support system of claim 19 wherein said zone has a transverse dimension greater than 25% of a transverse dimension of said frame.

21. The body support system of claim 19 wherein said fluidizing device and said transferring device jointly comprise:

at least two material manipulation devices supported by said frame, said material manipulation devices being located along said longitudinal dimension of said frame, and each of said material manipulation devices including:

a shaft member rotatable on an axis of rotation oriented at an angle in a range of 60° to 120° relative to said longitudinal axis of said frame;

a blade member connected to said shaft member; and a rotation mechanism to rotate said shaft member reversibly, wherein selective rotation of said shaft member facilitates said fluidizing and transference of said granular material.

22. A body support system comprising:

(a) a frame having a wall and a floor with a plurality of channels disposed on an upper side of said floor;

(b) a mass of granular material disposed in said frame for supporting said body; and (c) at least two devices supported by said frame, said devices being located at spaced locations along a longitudinal dimension of said frame, each of said devices being housed in one of said channels at least partially, and each of said devices including:

a shaft member rotatable on an axis of rotation substantially parallel to a corresponding channel;

a blade assembly connected to said shaft member; and a rotation mechanism to rotate said shaft member reversibly, wherein rotation of said shaft member manipulates said granular material to selectively adapt said system to said supported body.

23. The body support system of claim 22 wherein:

each said channel is oriented at an angle in a range of 60° to 120° relative to a longitudinal axis of said frame;

said blade assembly includes plural blade members; and said blade assembly is arranged on said shaft member within a zone disposed between a central longitudinal axis of said frame and a transverse side of said frame, said zone having a transverse dimension which is at least 25% of a transverse dimension of said frame, said zone defining a blade union including all blade members of said blade assembly disposed within said zone, and said blade union moving said granular material passing through said zone when said shaft member is rotated about said axis of rotation.

24. The body support system of claim 22 wherein a vertical depth of each said channel is greater than an external radius of rotation of a corresponding device blade assembly.

25. The body support system of claim 22 wherein respective blade assemblies of adjoining devices have substantially mirror symmetrical screw directions.

26. The body support system of claim 22 wherein adjoining device shaft members have opposing rotation directions when said adjoining devices transfer said granular material from a transverse middle portion to a transverse side portion of said frame.

27. The body support system of claim 22 further including:

a safety net member connected to a wall of each said channel.

28. The body support system of claim 22 further including:

(d) an air permeable sheet connected to said wall of said frame and to a wall of a particular channel, wherein said air permeable sheet, said frame and said wall of said particular channel collectively define a cell, said cell containing a portion of said mass of granular material.

29. The body support system of claim 22 further including:

(d) a plurality of partitions supported in said frame, each said partition forming a wall of a corresponding channel.

30. In a body support system including a frame having a mass of granular material disposed therein for supporting a body, a method of adapting to and supporting said body comprising the steps of:

(a) selectively altering a state of said granular material between fluid and stationary states; and (b) selectively distributing said granular material to particular sections within said frame by transferring said granular material reversibly between said particular frame sections to adjust said granular material to conform to said supported body.

31. In a body support system including a frame having a mass of granular material disposed therein for supporting a body, a method of adapting to and supporting said body comprising the steps of:

(a) selectively altering a state of said granular material between fluid and stationary states, wherein step (a) further includes:

(a.1) independently controlling fluidizing of said granular material at more than one location along a longitudinal dimension of said frame; and (b) selectively distributing said granular material to particular sections within said frame to adjust said system to conform to said supported body, wherein step (b) further includes:

(b.1) transferring said granular material reversibly between a transverse middle portion and transverse side portions of said frame; and (b.2) independently controlling said transferring of said granular material at more than one location along said longitudinal dimension of said frame.

32. In a body support system including a frame having a mass of granular material disposed therein for supporting a body and at least two devices supported by said frame, said devices being located at spaced locations along a longitudinal dimension of said frame, and each of said devices includes a shaft member rotatable about an axis of rotation, a blade member connected to said shaft member and a rotation mechanism to rotate said shaft member reversibly, a method of adapting to and supporting said body comprising the steps of:

(a) selectively altering a state of said granular material between fluid and stationary states; and (b) selectively distributing said granular material to particular sections within said frame to adjust said system to conform to said supported body, wherein step (b) further includes:

(b.1) selectively rotating said shaft member of each said device to facilitate said state alteration and distribution of said granular material.

* * * * *